US011383349B2

(12) United States Patent
Sullivan

(10) Patent No.: US 11,383,349 B2
(45) Date of Patent: Jul. 12, 2022

(54) REDUCED NOISE ABRASIVE BLASTING SYSTEMS

(71) Applicant: OCEANIT LABORATORIES, INC., Honolulu, HI (US)

(72) Inventor: Christopher Sullivan, Honolulu, HI (US)

(73) Assignee: Oceanit Laboratories, Inc., Honolulu, HI (US)

( * ) Notice: Subject to any disclaimer, the term of this patent is extended or adjusted under 35 U.S.C. 154(b) by 831 days.

(21) Appl. No.: 16/216,972

(22) Filed: Dec. 11, 2018

(65) Prior Publication Data

US 2020/0130140 A1 Apr. 30, 2020

Related U.S. Application Data

(63) Continuation-in-part of application No. 14/826,694, filed on Aug. 14, 2015, now Pat. No. 10,150,203.

(60) Provisional application No. 62/039,891, filed on Aug. 20, 2014.

(51) Int. Cl.

| | |
|---|---|
| ***B24C 5/04*** | (2006.01) |
| ***B24C 3/02*** | (2006.01) |
| ***B24C 7/00*** | (2006.01) |

(52) U.S. Cl.

CPC ..... *B24C 5/04* (2013.01); *B24C 3/02* (2013.01); *B24C 7/0046* (2013.01); *B24C 7/0053* (2013.01); *B24C 7/0061* (2013.01)

(58) Field of Classification Search

CPC ..... B24C 5/02; B24C 5/04; B24C 7/0046; B24C 7/0053; B24C 7/0061; B24C 3/02

USPC ..... 451/102

See application file for complete search history.

(56) References Cited

U.S. PATENT DOCUMENTS

| | | | | |
|---|---|---|---|---|
| 578,983 A | | 3/1897 | Green | |
| 1,940,972 A | | 12/1933 | Schwartzkopf | |
| 2,888,191 A | * | 5/1959 | Lustwerk | F04F 5/461 417/182 |
| 3,032,930 A | * | 5/1962 | Williams | B24C 5/04 451/102 |
| 3,612,405 A | | 12/1971 | Heinrich | |

(Continued)

OTHER PUBLICATIONS

Settles, G.S. and Garg, S., A Scientific View of the Productivity of Abrasive Blasting Nozzles, Journal ofThermal Spray Technology, Mar. 1996, pp. 35-41, vol. 5(1 ), ASM International.

(Continued)

*Primary Examiner* — Eileen P Morgan

(74) *Attorney, Agent, or Firm* — Fresh IP PLC; Clifford D. Hyra; Aubrey Y Chen

(57) ABSTRACT

Reduced noise abrasive blasting assemblies and systems are described. The new assemblies and systems are comprised of standard blast hose, accelerator hose, couplings and nozzle. The improved abrasive blasting system maintains abrasive particle velocity while decreasing the exit gas velocity and consequently decreasing sound production. This is accomplished through an acceleration section with reduced inner diameter and sufficient length to provide the necessary abrasive particle velocity. The new system maintains the productivity and efficiency of conventional abrasive blasting systems but with greatly reduced acoustic noise production and reduces operator fatigue due to the lower weight of the carried portion of the system.

12 Claims, 21 Drawing Sheets

(56) References Cited

U.S. PATENT DOCUMENTS 3,788,676 A 1/1974 Lossie
3,982,605 A * 9/1976 Sneckenberger ..... B05B 1/005 181/247
4,134,547 A * 1/1979 Gamst ..... A62C 31/00 239/404
4,253,610 A * 3/1981 Larkin ..... B24C 7/0084 239/430
4,644,974 A * 2/1987 Zingg ..... B24C 5/04 138/44
4,666,083 A * 5/1987 Yie ..... B05B 7/1486 239/403
4,681,372 A * 7/1987 McClure ..... E02F 3/88 299/8
4,708,214 A 11/1987 Krawza
4,708,534 A 11/1987 Gallant
5,283,990 A 2/1994 Shank, Jr.
5,335,459 A * 8/1994 Dale ..... B05B 7/10 451/102
5,365,702 A 11/1994 Shank, Jr.
5,390,450 A * 2/1995 Goenka ..... B24C 1/003 451/102
5,484,325 A * 1/1996 Shank ..... B24C 5/00 451/102
5,545,073 A * 8/1996 Kneisel ..... B05B 1/005 134/7
5,671,954 A 9/1997 Cheramie
5,795,626 A * 8/1998 Gabel ..... B05B 5/047 427/458
5,957,760 A * 9/1999 LaSalle ..... B24C 5/04 451/90
5,975,996 A * 11/1999 Settles ..... B24C 5/04 239/589
6,036,584 A 3/2000 Swinkels
6,390,898 B1 5/2002 Pieper
6,851,627 B2 * 2/2005 Hashish ..... B24C 5/04 239/424
6,935,576 B2 * 8/2005 Hara ..... B05B 15/55 239/104
7,059,543 B2 * 6/2006 Dushkin ..... B05B 7/0425 239/390
8,389,066 B2 * 3/2013 Vijay ..... C23C 4/02 427/446
8,578,971 B2 * 11/2013 Brown ..... G01F 1/662 138/44
9,931,639 B2 * 4/2018 Lehnig ..... B02C 23/16

OTHER PUBLICATIONS

Settles, Gary S. and Geppert, Stephen T., Redesigning Blasting Nozzles to Improve Productivity, Journal of Protective Coatings & Linings, Oct. 1996, pp. 64-72, vol. 13(10).
Powell, Alan, On the Generation of Noise by Turbulent Jets, ASME Publication, 1959.

* cited by examiner

REDUCED NOISE ABRASIVE BLASTING SYSTEMS

CROSS-REFERENCE TO RELATED APPLICATIONS

This application is a continuation-in part of U.S. nonprovisional patent application Ser. No. 14/826,694, filed Aug. 14, 2015, which claims the benefit of U.S. provisional patent application Ser. No. 62/039,891 filed Aug. 20, 2014 by the present inventors, which provisional application is incorporated in its entirety by this reference.

STATEMENT REGARDING FEDERALLY SPONSORED RESEARCH OR DEVELOPMENT

This invention was supported in part by government support under Contract FA8222-14-M-0006 with the Department of the Air Force. The government has certain rights in the invention.

FIELD OF THE INVENTION

The invention relates to apparatus and methods for abrasive blasting. More particularly, the invention describes reduced noise abrasive blasting assemblies and systems and methods of constructing such systems.

BACKGROUND OF THE INVENTION

Abrasive blasting operations used for paint and surface coating removal are essential to the maintenance of the ships, aircraft, and land vehicles of the US armed forces, as well as to industrial vehicles and machinery. But these operations expose maintenance personnel to sound pressure levels (SPLs) of 119 dB and greater on a routine basis, which result in significant health, productivity and compliance issues for blast operators. Many blast operators experience hearing loss as a direct result of prolonged exposure to blast noise. Personal protective equipment (PPE) such as earplugs and earmuffs can reduce the immediate risk but introduces a loss of situational awareness and still does not satisfy OSHA-level requirements for noise exposure limits. The OSHA noise standard (29 CFR 1910.95), limits a worker's permissible noise exposure limit (PEL) to a time-weighted average of 90 dBA for 8 hours, and better hearing protection is not considered to reduce worker noise exposure. Only by reducing sound at its source will a worker experience non-hazardous noise.

Illustrated in FIG. 1 is a conventional, state of the art supersonic abrasive blasting system 10 comprising a compressor 12, compressor hose 14, and abrasive tank 16 containing abrasive media 18. An abrasive metering valve 20 controls the rate of release of abrasive media 18 into a standard blast hose 22. Release media 18 travels through a blast hose 22 to a claw coupling 24 and through supersonic convergent-divergent nozzle 26 where it is released into the environment at supersonic speed and with considerable noise.

Details of state of the art convergent-divergent nozzle 26 are depicted in FIG. 2 in cross section. Nozzle 26 is comprised of a barrel 28 having a bore 30 with a convergent bore section 32, throat 34, and divergent bore section 36. Gases mixed with abrasive media 18 are compressed when traveling through convergent section 32 and then dispersed through divergent section 36, causing media 18 particles to accelerate within the divergent section 36 of nozzle 26 and out therefrom.

Conventional abrasive blasting system setups utilize a single 1" inner diameter blast hose 22 with a convergent-divergent type supersonic nozzle attachment 26. The abrasive blasting media in these setups undergo most of their acceleration over a short distance in and following exit from nozzle 26.

As demonstrated in Settles' paper (Settles G., A scientific view of the productivity of abrasive blasting nozzles, 1996), particles accelerate from fairly modest velocities before the nozzle, to higher velocities as the particles flow through the diverging portion of the nozzle and the exit. This minimizes wear in the hose, especially for highly abrasive media. This behavior is illustrated in the graphs reproduced from Settles' paper in FIG. 3, showing predicted and measured velocities through a Laval nozzle. As shown, particle velocity remains well under 50% of gas velocity throughout the nozzle.

Currently available abrasive blasting systems as the one depicted in FIGS. 1 and 2 produce excessive noise which exceeds levels set by occupational safety organizations for work environment noise and, as a result, require the use of personal protective equipment for hearing protection as well as time limits for operator exposure to this noise. Accordingly, there is a need for abrasive blasting systems that produce less noise, reducing noise-induced hearing loss and/or tinnitus and improving situational awareness in noisy operational environments, while still demonstrating equivalent productivity and efficiency.

Currently available abrasive blasting systems as the one depicted in FIGS. 1 and 2 are large and heavy, creating stress and fatigue for the user. As such, there is a need for abrasive blasting systems that are smaller and lighter for ease of use and longer periods of use.

SUMMARY OF THE INVENTION

These and other objects are accomplished in the reduced noise abrasive blasting assemblies and systems of the subject invention. The new assemblies and systems provide for effective abrasive blasting with significantly less noise than current state of art while reducing ergonomic stress from the size and weight of the carried portion of the systems.

The new assemblies and systems provide a greater length over which the particles are accelerated prior to exit, either in hosing, a nozzle, or both, bringing particle velocity closer to gas velocity at exit and enabling use of a lower gas exit velocity to reduce system noise while maintaining or even improving productivity. While amount of blasting time is related to noise exposure (due e.g. to regulatory compliance issues), productivity of a nozzle, which is related to velocity of the abrasive exiting the nozzle, is of equal concern in abrasive blasting. A higher velocity means that the blast operator can spend less time blasting per square meter. Less time translates to higher worker productivity and lower operational costs.

New assemblies and systems in some embodiments are comprised of standard blast hose, a novel accelerator hose portion, couplings including a transition coupling, and nozzle. This improved abrasive blasting system maintains the desired abrasive particle velocity while decreasing the exit gas velocity and consequently decreasing sound production. This is accomplished through an acceleration hose section with reduced inner diameter and sufficient length to provide the necessary abrasive particle velocity. The new systems maintain the productivity and efficiency of conventional abrasive blasting systems but with greatly reduced acoustic noise production and reduced operator fatigue due to the lower weight of the carried portion of the system.

One aspect of the subject invention is abrasive blasting apparatus that produce significantly less noise than conventional supersonic abrasive blasting systems while demonstrating equivalent or superior efficiency and blasting results when compared with prior art supersonic abrasive blasting apparatus.

A further aspect of the subject invention is abrasive blasting apparatus having a carried portion that is smaller and lighter than conventional supersonic abrasive blasting systems while demonstrating equivalent or superior efficiency and results.

Another aspect of the subject invention is abrasive blasting systems that employ a length of accelerator hose having an inside diameter smaller than conventional standard blast hose, taken over an additional length, to accelerate the media particles to a desired velocity prior to the particles entering the blast nozzle.

A further aspect of the subject invention is the use of transition coupling to step down the inner diameter of the media path from the standard blast hose to the accelerator hose.

Another aspect of the subject invention is abrasive blasting systems that employ a nozzle having a straight section following a diverging section, to accelerate the media particles to a desired velocity prior to the particles exiting the blast nozzle.

New assemblies and systems in some embodiments are comprised of a hose and nozzle assembly, the hose and nozzle assembly having a first portion having a first internal diameter, a constricted portion having an internal diameter less than the first internal diameter, a converging portion connecting the first portion to the constricted portion and having a converging internal diameter, and a straight portion downstream from the constricted portion, having a constant internal diameter less than that of the first portion. The straight portion has a length such that a velocity of gas exiting the blasting nozzle assembly is reduced by at least 30% relative to the blasting nozzle assembly without the straight portion when operated with a predetermined gas/particle mix and pressure. Any reduction in noise that does not compromise productivity of the system or make the nozzle unwieldy or difficult to control is desirable. A reduction of exiting gas velocity of only 7% results in a 3 dB noise reduction, which is a noticeable improvement. In various embodiments, the length of the straight portion is effective to reduce exiting gas velocity when operated with a predetermined gas/particle mix and pressure by between 7% and 43%, in some embodiments between 30% and 40%, and in some embodiments by 35%. In operation, fluid flows through the first portion, the converging portion, the constricted portion and the straight portion in that order.

In some embodiments, the constricted portion, converging portion, and straight portion are all portions of a nozzle, which may also have a diverging portion connecting the constricted portion with the straight portion. The converging portion, constricted portion, diverging portion and straight portion may together constitute a nozzle and the constricted portion may be the throat of the nozzle. The straight portion may be at least 2" in length and less than 5.2" in length, and in some embodiments 2.5" in length. The nozzle may be a #6 nozzle. In other embodiments, it may be any diameter nozzle.

In some embodiments, the internal diameter of the straight portion is selected to produce a predetermined "hot spot" diameter of abrasive action.

The reduced noise abrasive blasting nozzle assembly in some embodiments also includes a media tank, abrasive media, and compressed gas to carry the abrasive media, and the hose and nozzle assembly includes one or more hose sections.

The subject invention achieves sufficient abrasive particle velocity through greater acceleration distances in an airstream with a lower exit velocity, thereby reducing the nozzle generated noise experienced with supersonic blast nozzles. Adjustments to blasting productivity can be made by adjusting the abrasive mass flow rate.

DETAILED DESCRIPTION OF PREFERRED EMBODIMENTS

Solutions to the problem of excessive noise from state of the art supersonic abrasive blasting systems are found as set forth in the following.

Figure 4:
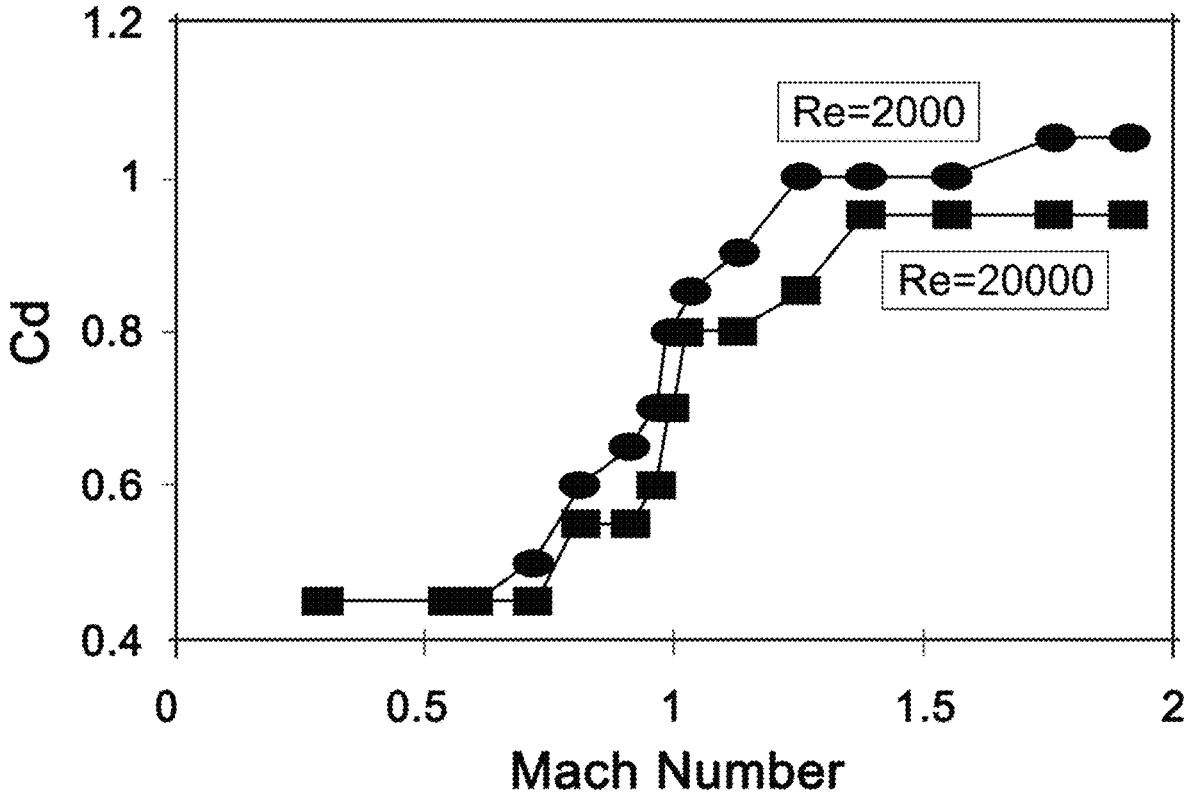
FIG. 4 is a graph showing the drag coefficient as a function of Mach number for two Reynolds numbers for spheres.

The acceleration of particles in a stream can be modeled using empirically determined drag coefficient presented previously (Settles & Geppert, 1997) based on data from Bailey and Hialt. The acceleration of a particle of mass, m, is found from the drag, D, as $$a = \frac{D}{m} = \frac{1}{m}\frac{1}{2}\rho U_{rel}^2 A C_d$$

where A is the cross-sectional area of the sphere and $U_{rel}$ is the relative velocity between the gas and the particle. Illustrated in FIG. 4 is the drag coefficient as a function of Mach number for two Reynolds numbers for spheres.

Previous studies have demonstrated that the noise power, P, of a jet scales with the eighth power of velocity and the square of jet diameter (Powell, 1959) as $$P \propto U^8 D^2$$

Furthermore, sound pressure level, SPL, is proportional to sound power level, SWL where $$SWL = 10\log\left(\frac{\text{Power}}{1\times 10^{-12} W}\right)$$

As a result, it can be inferred that SPL, velocity and diameter scale as:

$$SPL_2 - SPL_1 = 80\log = \frac{U_2}{U_1}$$

Figure 5:
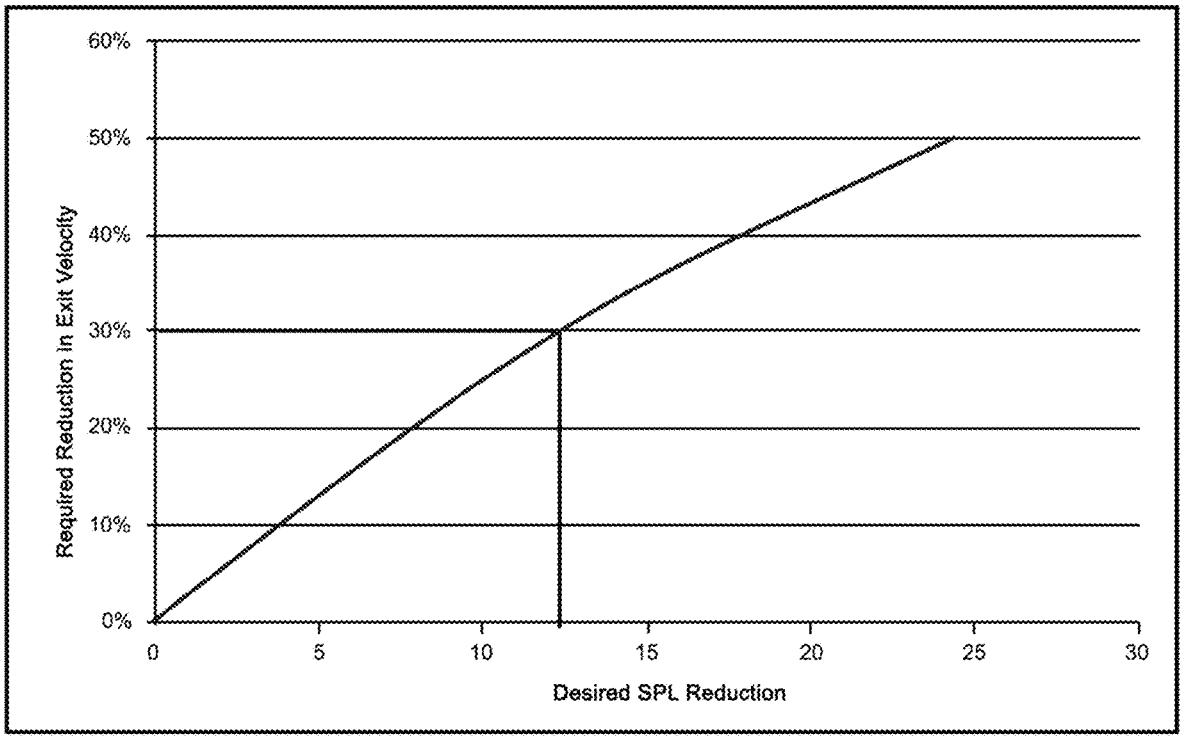
FIG. 5 is a graph showing the required reduction in jet exit velocity to achieve desired reduction in Sound Pressure Level (SPL) based on the relationship of jet exit velocity to jet noise production.

This relationship is shown in graph form in FIG. 5. Thus, if the exit velocity of the nozzle is reduced by 30%, for example, then a drop in SPL of 12.5 dB is expected, while a reduction in exit velocity of 43% would result in an expected drop in SPL of 20 dB.

Figure 1:
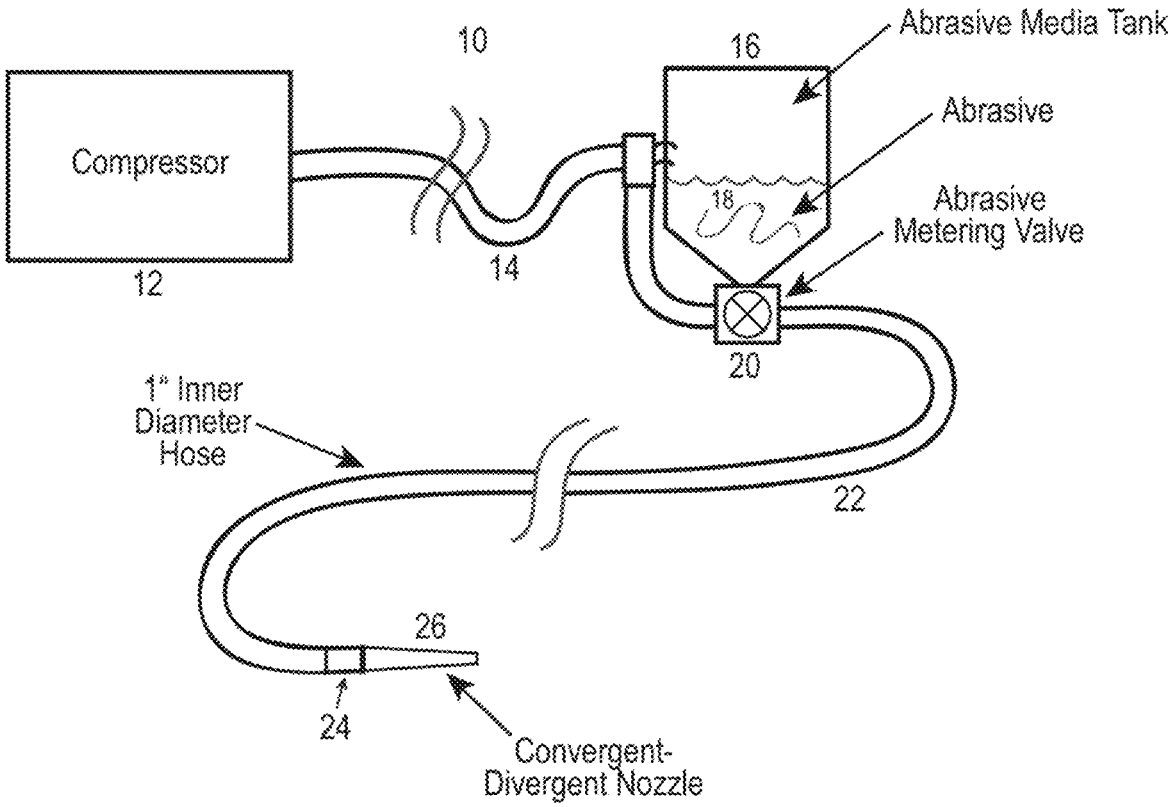
FIG. 1 illustrates a conventional state of the art supersonic abrasive blasting system.
Figure 2:
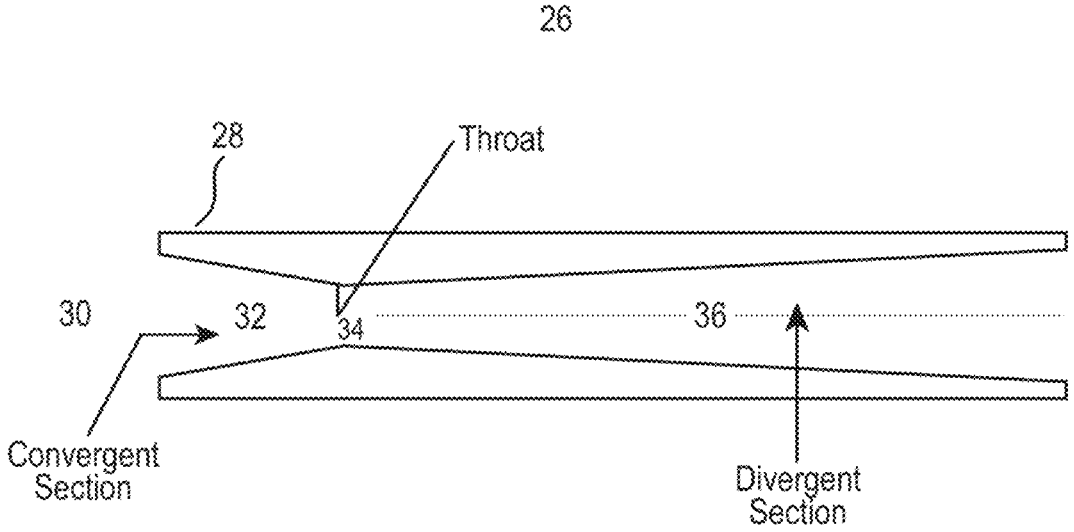
FIG. 2 depicts, in cross section, a conventional supersonic convergent-divergent nozzle used in the abrasive blasting system illustrated in FIG. 1.
Figure 3:
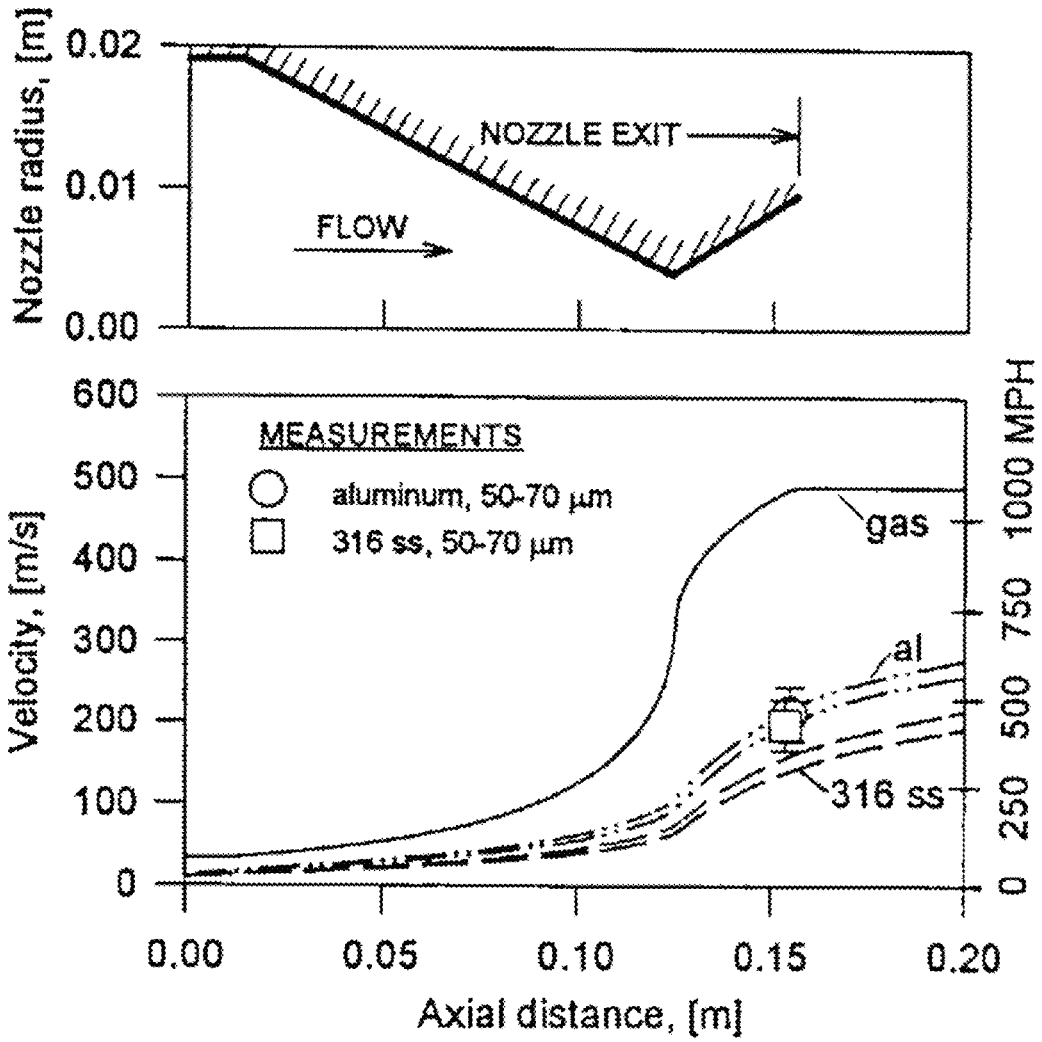
FIG. 3 reproduce graphs from Settles' paper (Settles G., A scientific view of the productivity of abrasive blasting nozzles, 1996), showing predicted and measured velocities through a conventional Laval nozzle and the large difference between abrasive velocity and exit gas velocity.

In order to have the same production as a current state of the art nozzle blasting system, the velocity of the particles must be maintained. Conventional nozzles, as illustrated in FIG. 2, have much higher gas velocities than particle velocities, and these high gas velocities are responsible for high sound production levels. The subject invention maintains the particle velocity while decreasing the nozzle exit gas velocity and such, decreasing the sound production. This requires a longer acceleration length relative to conventional art nozzle blasting systems.

The mass of the sphere is the density of the particle, $\rho_{partide}$ multiplied by the volume $\frac{4}{3}\pi r^3$. So acceleration becomes $$a = \frac{3}{8} C_d \frac{\rho_{gas}}{\rho_{particle}} \frac{U_{rel}^2}{r}$$

Figure 6:
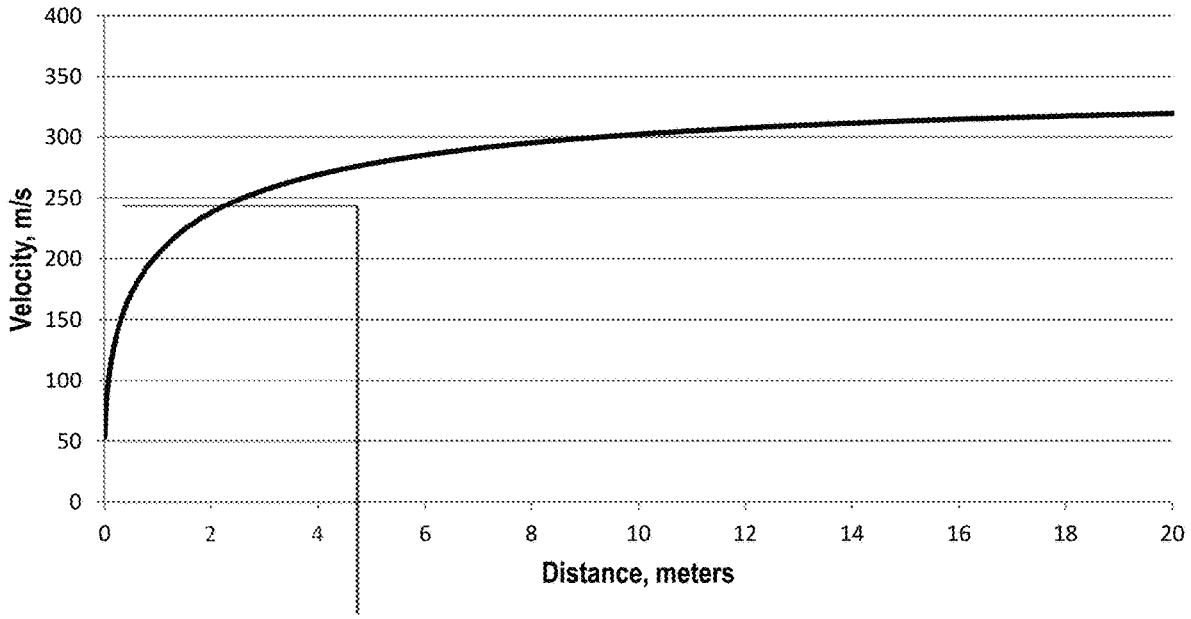
FIG. 6 is a graph demonstrating modeled particle velocity versus distance in 345 m/s accelerator section for Type V acrylic media 20/30 mesh.

The solution can be found in a stepwise manner and is shown in FIG. 6 for Type V acrylic media of 20/30 mesh in an air stream with a velocity of 345 m/s. This demonstrates that to achieve 275 m/s particle velocity a 4 meter accelerator section is required in the hosing.

Based on an estimated exit velocity of 483 m/s from a previous model of the Marco #8 nozzle operating at 40 psi pressure, an exit velocity reduction of 30% to 345 m/s (roughly sonic) produced a 12.5 dB reduction in SPL. The length of hose then needs to be sufficiently long to match the particle velocity of the #8 nozzle at 40 psi.

The instant invention achieves sufficient abrasive particle velocity through greater acceleration distances in an airstream with a lower exit velocity, thereby reducing nozzle generated noise experience with supersonic blast nozzles. Adjustments to blasting productivity can be made by adjusting the abrasive mass flow rate.

Figure 7:
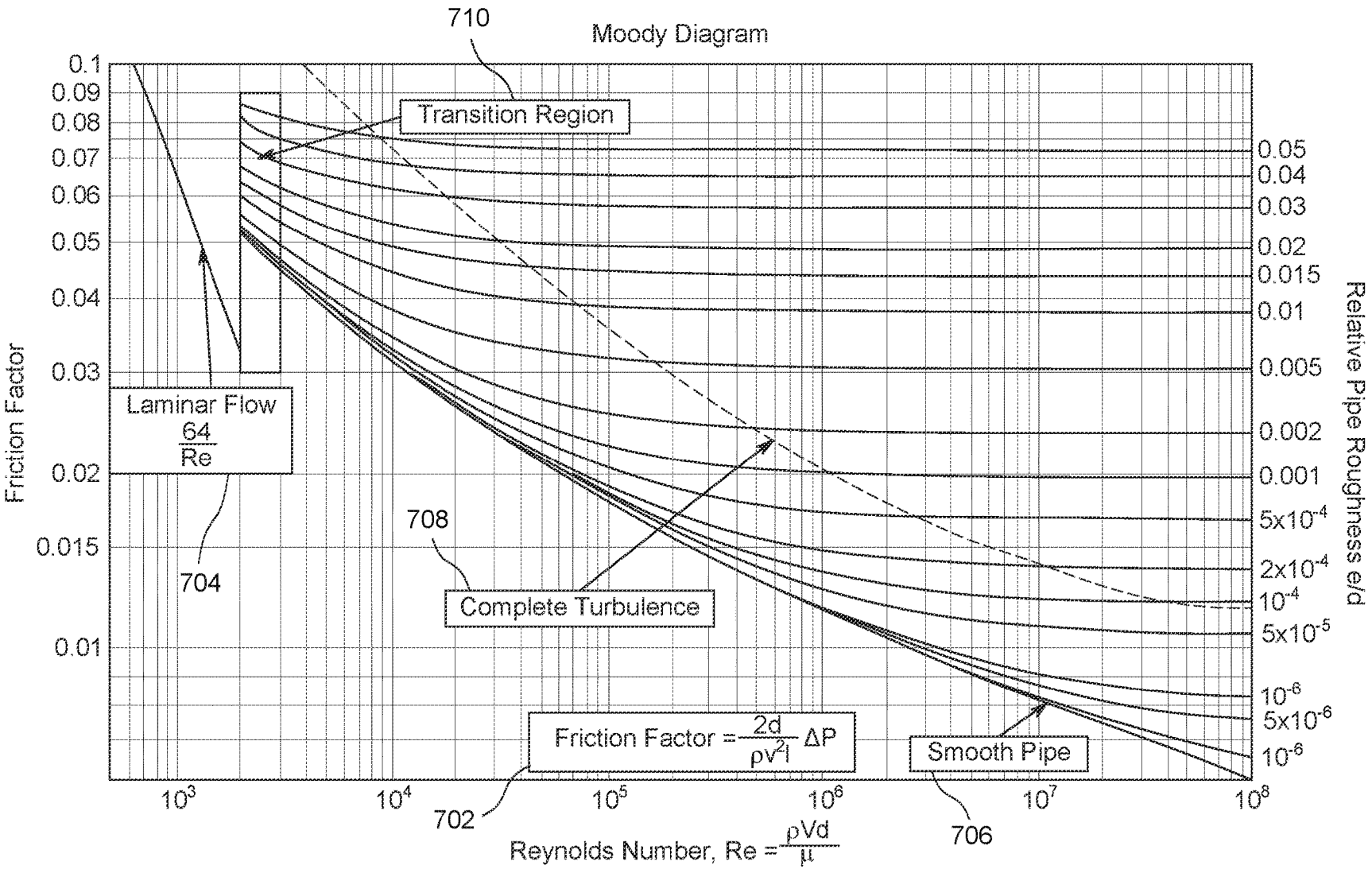
FIG. 7 is a Moody Diagram used for estimation of Friction Factor from Reynolds Number and pipe roughness.

Pressure loss, or head loss, is unavoidable and must be considered. As the length of the hose increases, the pressure will decrease and eventually decrease the flow velocity. But this loss can be calculated. The head loss, or pressure loss, due to friction along a pipe is given by the Darcy-Weisbach equation as $$\Delta p = f_D \frac{L}{D}\frac{\rho V^2}{2}$$

where L is the length of the pipe section, D is the pipe diameter, ρ is the density of the fluid, V is the average fluid velocity, and $f_D$ is the Darcy friction factor based on Reynolds Number, Re and relative pipe roughness, ϵ/d and is equal to approximately 0.02 for plastic/rubber. FIG. 7 shows a Moody Diagram used for estimation of Friction Factor from Reynolds Number and pipe roughness. The Friction Factor is calculated as shown in box 702, while laminar flow is shown by line 704. A curve for a smooth pipe is shown at 706, while a curve for comlete turbulance is shown at 708. A transition region is also shown at 710 for the various curves.

A ¾" inner diameter blast hose operating close to "choked" condition has a velocity of 230 to 340 m/s and a Reynolds number of 300,000 to 436,000. Drag over the length of the hose induces pressure losses which decrease the average velocity in the pipe.

Velocity in the hose will be sonic if the choked flow conditions exist where the pressure downstream falls below a critical value, $$\frac{p*}{p_0} = \left(\frac{2}{k+1}\right)^{\frac{k}{k-1}}$$

where the heat capacity ratio, k, is 1.4 for air, giving $$p^{+}=0.528p_0$$

For 40 psi gage pressure, or 54.7 psi absolute pressure, p* is 28.9 psia or 14.2 psig.

Based on the results of analytical models discussed above, a preferred embodiment of the subject invention was designed that takes airborne particles from the example 1" hose and accelerates them through a smaller diameter hose a sufficient distance such that a productive particle speed is obtained. Transition couplings that step down the inside diameter of the hose provide smooth transitions between the different hose section diameters with minimal pressure losses.

Figure 8:
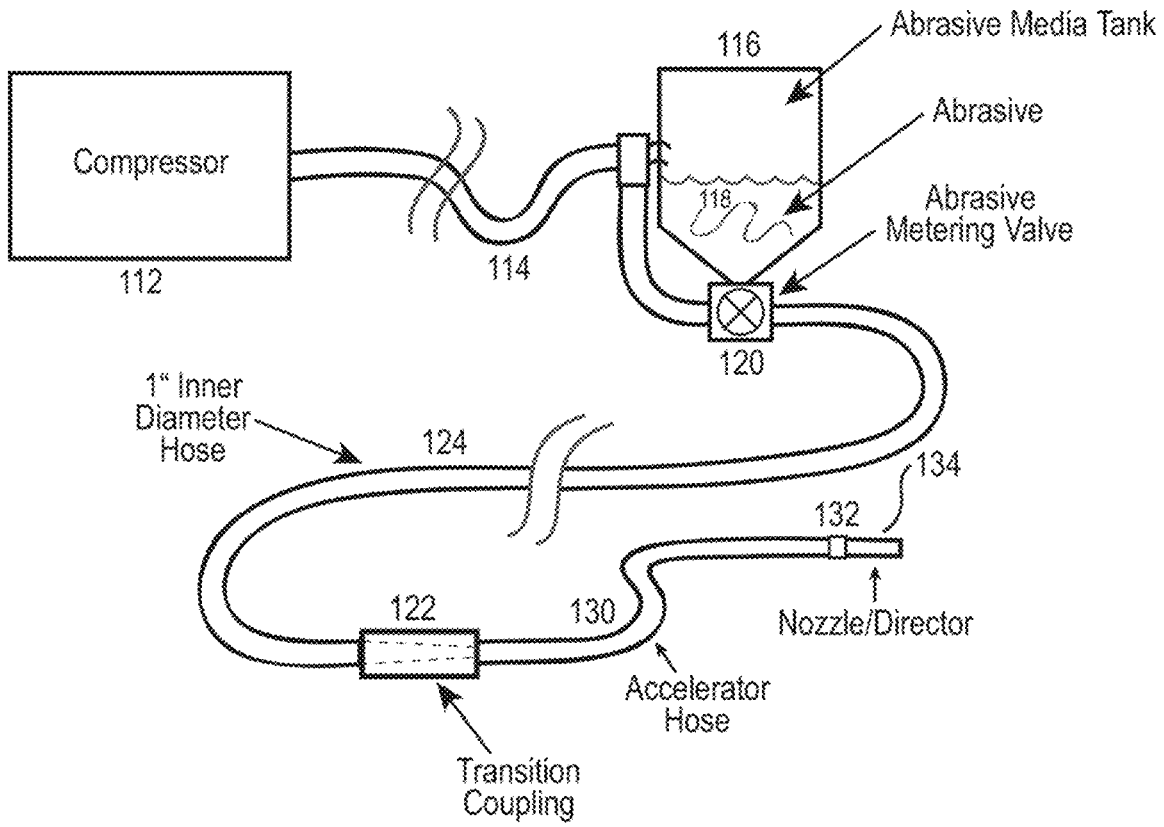
FIG. 8 illustrates the major component parts of a preferred embodiment of the improved reduced noise abrasive blasting system of the subject invention.

According to a preferred embodiment of the reduced noise abrasive blasting systems of the subject invention depicted in FIG. 8, compressor 112 pressurizes gas to near 120 psi. Compressed gas is pumped through initial hose section 114 into abrasive media tank 116 containing abrasive media 118. An abrasive metering valve 120 controls the rate of release of abrasive media 118. A standard 1" inside diameter blast hose 124 attaches, at one end to metering valve 120 and, at the other end, to a transition coupling 122. A length of reduced inside diameter, ¾" for example, accelerator hose 130 connects transition coupling 122 to a nozzle 134 through a claw coupling 132. Transition coupling 122 serves to step down the inside diameter of the path that is taken by abrasive media 118 from the 1" diameter blast hose 124 to the smaller diameter acceleration hose 130.

Figure 9:
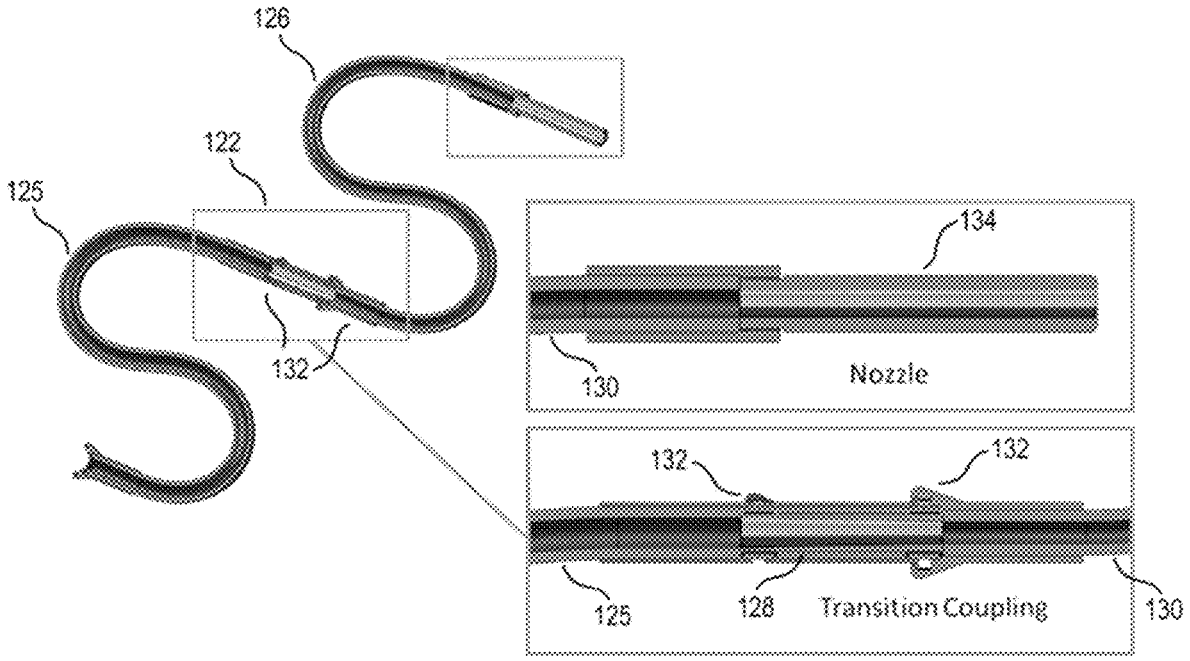
FIG. 9 shows, in cross-section, details of the transition coupling used to step down the inside diameter of the abrasive media path employed in the reduced noise abrasive blasting system illustrated in FIG. 8 and the relative geometry of the nozzle and accelerator hose.
Figure 9:
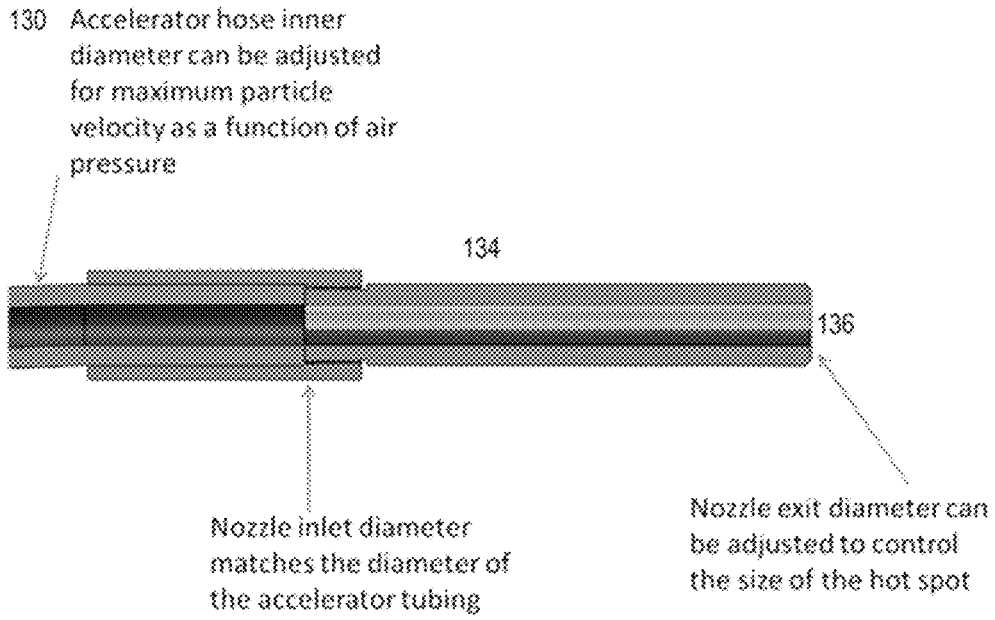

The details of transition coupling 122, and nozzle 134, are illustrated, in cross-section, in FIG. 9. Coupling 122 is comprised of housing 128 enclosing a bore (not shown). The blast hose side 125 of transition coupling 122 has a 1" inside diameter bore, while the accelerator side 130 of transition coupling 122 has a ¾" diameter bore. Each side of transition coupling 122 connects with the respective hose using conventional claw coupling 132 technology.

The nozzle 134 exit diameter 136 is sized to control the desired abrasive "hot spot" diameter such that the effective blasting region of the reduced noise abrasive blasting system can match that of a conventional supersonic nozzle.

Other preferred embodiments of the reduced noise abrasive blasting systems of the present invention are systems that comprise more than one section of acceleration hose and that employ more than one transition coupling, each section of acceleration hose having a decreasing inside diameter. Other types of couplings, nozzles, metering valves and abrasive media may be employed in the systems of the instant invention without departing from the scope of the invention.

EXAMPLES

Initial Prototype Fabrication and Testing

Figure 10:
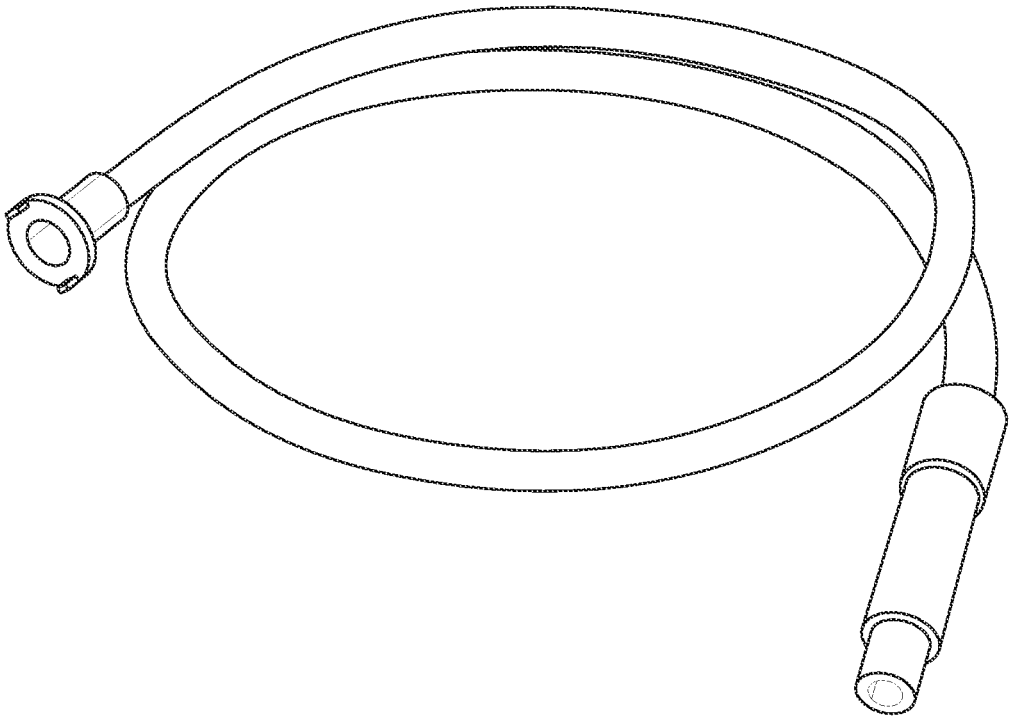
FIG. 10 is a photograph of a prototype reduced noise abrasive blasting accelerator hose and nozzle.

A prototype comprising the component parts illustrated in FIGS. 8 and 9 was fabricated as shown in FIG. 10 with the following characteristics for testing:

Four-meter accelerator section with ¾" inner diameter to achieve sonic conditions (345 m/s)

Straight bore nozzle with 0.79 bore diameter to match output diameter of #8 nozzle to achieve same "hot spot" as current standard #8 setup Couplers, etc.

Sound pressure levels were measured using both handheld integrating sound pressure meter and a stand-alone microphone data acquisition system. Nozzle pressures were measured near the end of the 1" hose before coupler to be 40 psi. Type V media was introduced by opening the media valve 4 full turns. Results of the sound pressure level testing, in dB, were as follows:

| Nozzle | Integrated SPL (dB) |
|---|---|
| Marco #8 | 108 |
| QB-1 Prototype | 94.5 |

Figure 11:
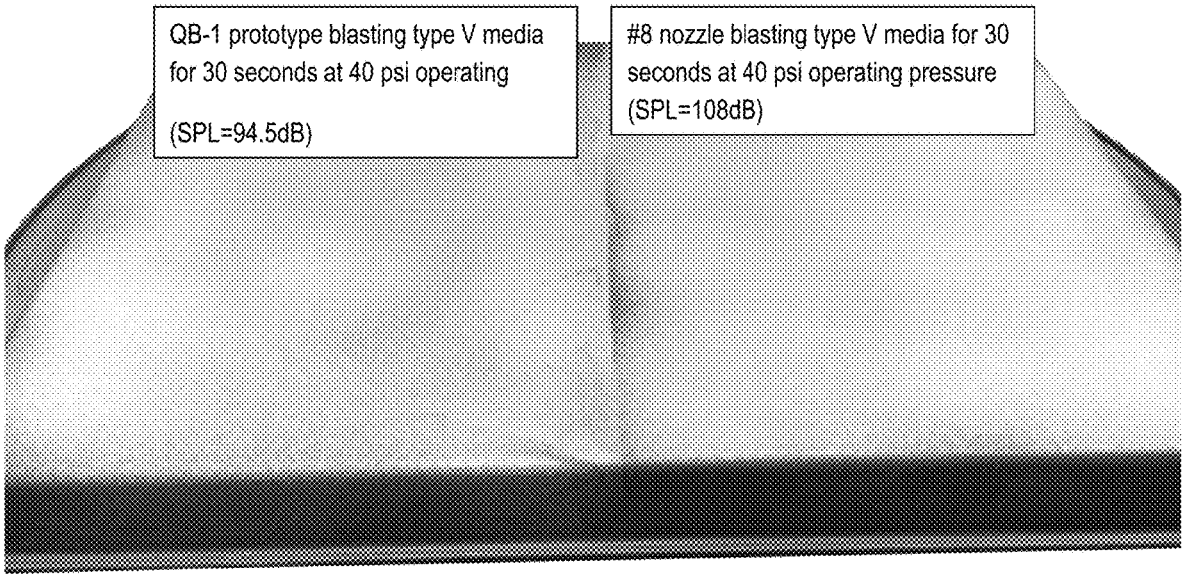
FIG. 11 is a photograph illustrating, in comparative format, productivity of the invention prototype (left side) and conventional blasting (right side) using #8 nozzle blasting Type V media on half of an exposed coated baking pan for 30 seconds, both with 4 turns of abrasive metering valve knob.

Productivity was qualitatively assessed by using both the #8 nozzle and the subject prototype for 30 seconds on an exposed half of a coated baking pan, as illustrated in FIG. 11. The effect of adjusting the abrasive metering valve knob was examined by adjusting the knob to six turns for the prototype and comparing the production of that setup to a Marco #8 nozzle that used the 4-turn setting.

Figure 12:
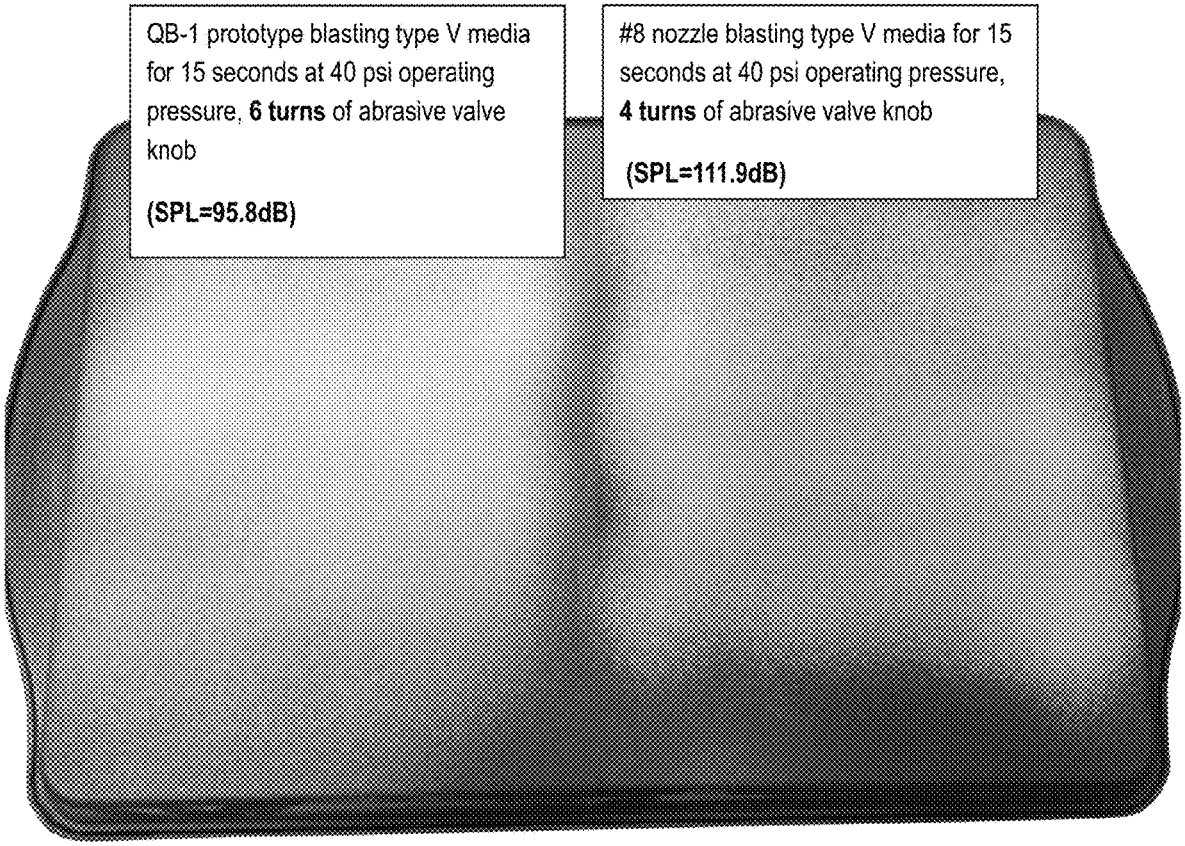
FIG. 12 is a photograph comparing the results of using a reduced noise blasting system of the subject invention operating with additional abrasive to a conventional system operating with a Marco #8 nozzle.

FIG. 12 illustrates that the prototype operating at the 6-turn setting was clearly more productive than the Marco #8 operating at the 4-turn setting. These results show that the subject invention can be operated with equal or better productivity compared to a standard #8 nozzle while producing 16 dB less noise as measured at the operator.

Figure 13:
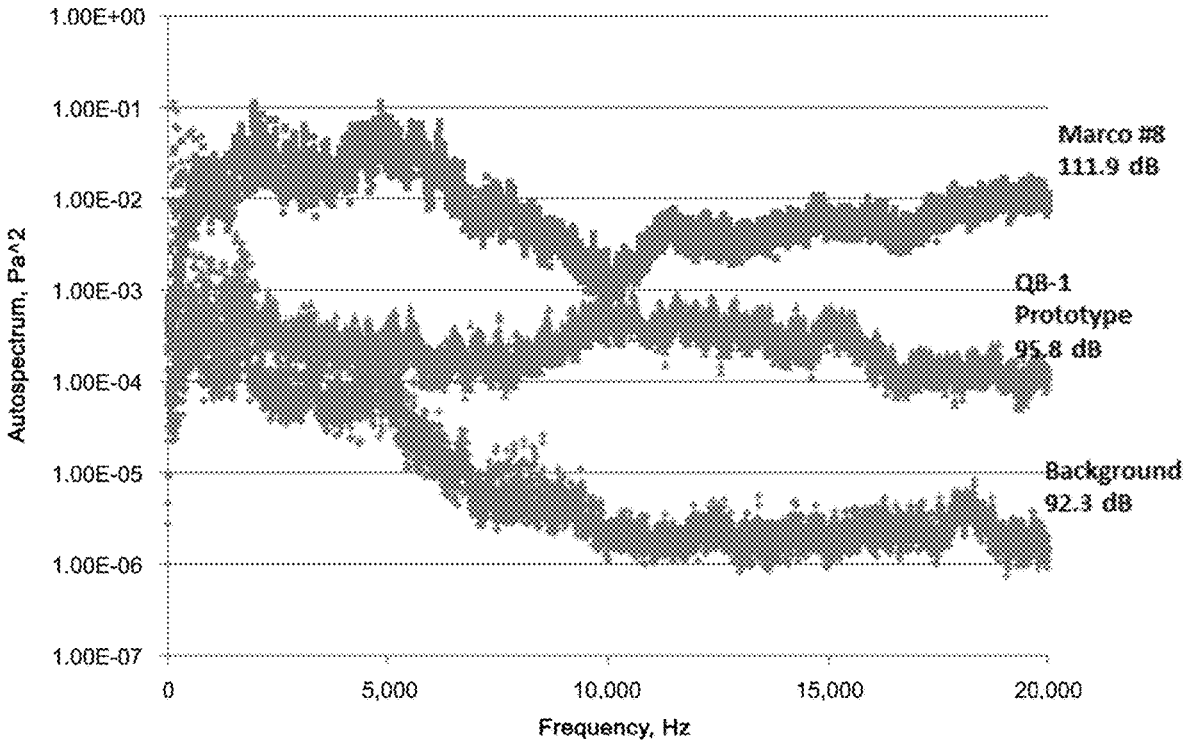
FIG. 13 is an autospectrum of a conventional state of the art supersonic abrasive blasting apparatus with a Marco #8 nozzle and the subject invention prototype with Type V media and 40 psi operating pressure, along with background noise levels from blasting compressor unit.

Testing was also performed to examine total sound pressure levels as well as acoustic spectra for the prototype as compared to a standard #8 nozzle, both operating at 40 psi. The testing results demonstrate noise reduction is broad spectrum, as illustrated in FIG. 13.

Other preferred embodiments of the reduced noise abrasive blasting systems of the present invention are systems that employ a new nozzle having a straight section following a diverging section, to accelerate the media particles to a desired velocity prior to the particles exiting the blast nozzle. Such low noise abrasive blasting nozzles are suitable to replace nozzles such as the Marco #6 Venturi nozzle with improved blasting productivity and reduced noise production. The exit shock condition of the new nozzles is designed to dramatically reduce jet noise from flow exiting the nozzle. Comparative testing between a new nozzle and an existing commercial nozzle achieved 17 dB(A) noise reduction while showing improvement in productivity in tests with garnet. CFD modeling shows an improved particle acceleration zone. Further, evaluation shows improved productivity and reduced noise with steel shot using a new nozzle versus a Marco #6 Venturi nozzle, with improved productivity, reduced acoustic noise, and reduced handling fatigue.

Figure 14A:
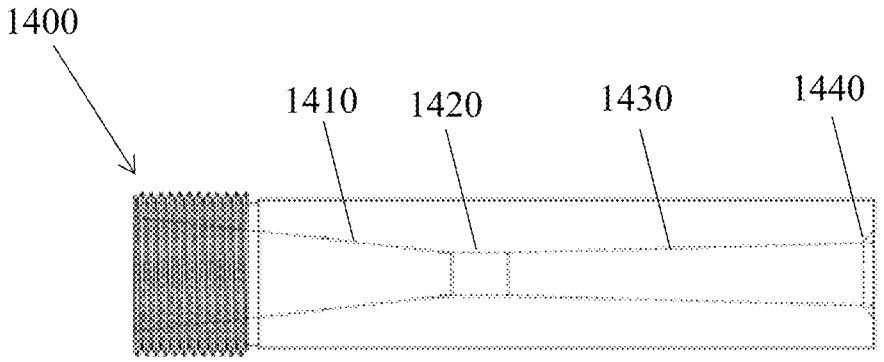
FIG. 14A-B are side and perspective see-through views, respectively, of a Marco #6 Venturi nozzle.
Figure 14B:
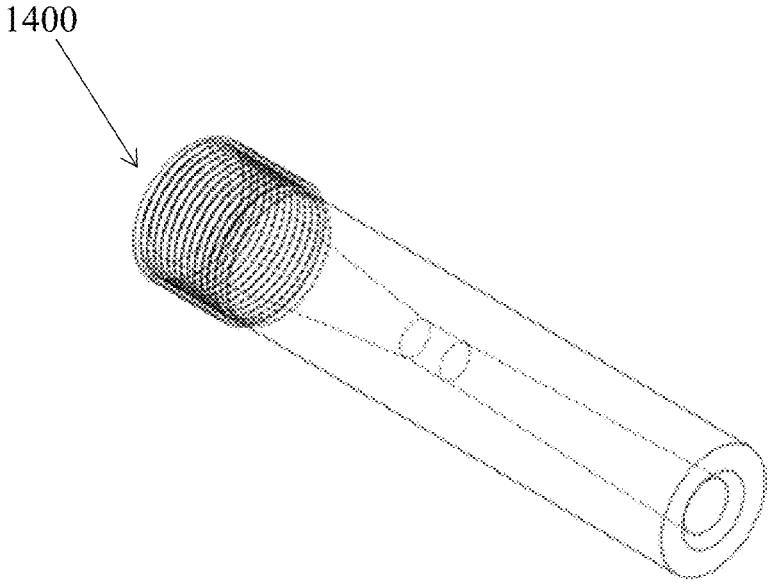
Figure 15:
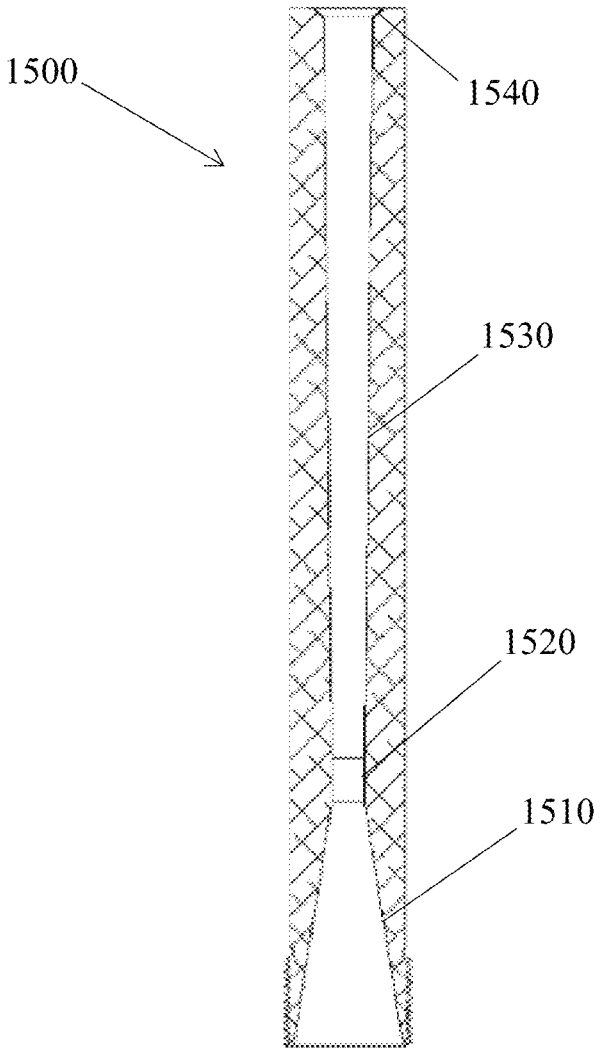
FIG. 15 is a sectional view of an XL Venturi #6 nozzle.

FIG. 14A-B are side and perspective see-through views, respectively, of a Marco #6 Venturi nozzle 1400. The total length of the nozzle depicted is 6.53", with a converging section 1410 2.80" in length, a throat 1420 0.50" in length, and a diverging section 1430 3.13" in length, a 1.25" inner diameter opening, a 0.38" diameter throat, and a 0.55" diameter exit. The exit portion 1440 is 0.10" in length and also diverging. A Venturi nozzle is the standard for abrasive blasting operations. Conventional nozzles are convergent/divergent nozzles such as the Marco #6. The particular version shown has a wide entry which is meant to enhance particle distribution homogeneity. It has a converging section at the inlet, a straight throat section of 6/16-inch diameter (thus the #6 designation) and then a diverging section that continues to the exit. The peak velocity of this design occurs at the exit (and beyond). FIG. 15 is a sectional view of an XL Venturi #6 nozzle 1500, which has a total length of 11.71 inches as depicted and a longer diverging section 1530 than the standard Marco #6 Venturi nozzle shown in FIGS. 14A-B (8.31" instead of 3.13"). The converging section 1510, throat 1520, and exit 1540 are identical.

Figure 16A:
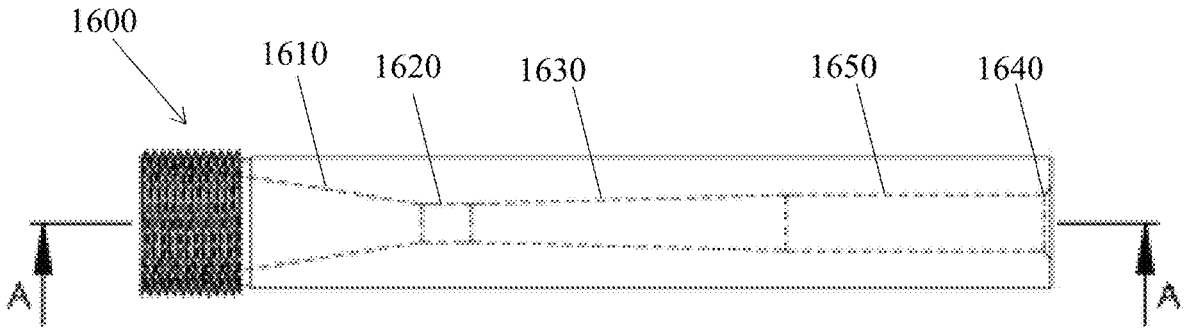
FIGS. 16A-B are a side see-through and sectional view, respectively, of an improved blast nozzle, according to an embodiment of the present invention.
Figure 16B:
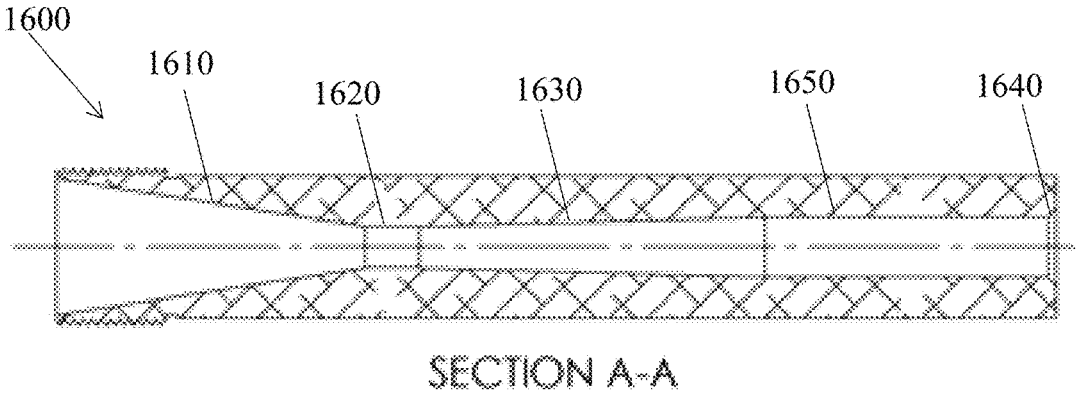
Figure 17A:
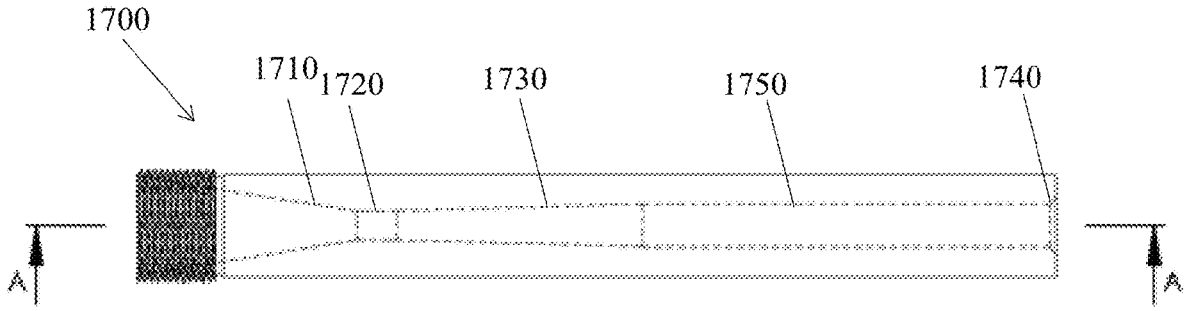
FIGS. 17A-B is a side see-through and sectional view, respectively, of an extended length improved blast nozzle, according to an embodiment of the present invention.
Figure 17B:
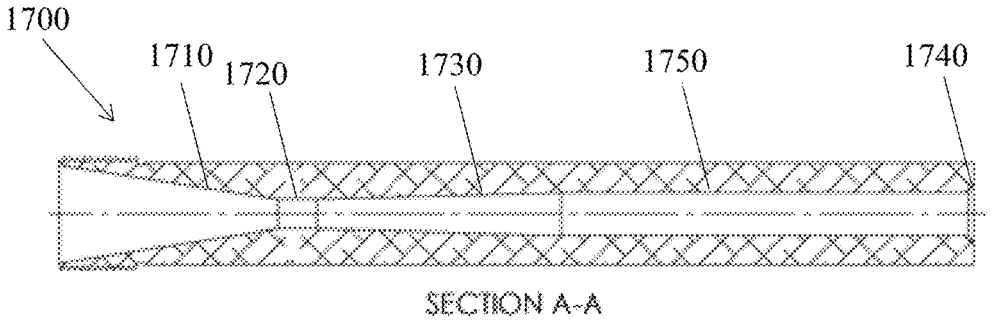

FIGS. 16A-B are a side see-through and sectional view, respectively, of an improved blast nozzle 1600, according to an embodiment of the present invention. The total length of the nozzle shown is 9.07", with a 0.50" long throat 1620, 3.13" long diverging section 1630, and 2.56" long straight section 1650, with converging portion 1610 making up the remaining length. The inner diameter of the opening is 1.25" the diameter of the throat is 0.375" and the diameter of the straight section is 0.55". The converging angle is 8.88 degrees and the angle of the diverging exit portion 1640 is 50 degrees. FIGS. 17A-B is a side see-through and sectional view, respectively, of an extended length improved blast nozzle 1700, according to an embodiment of the present invention, with converging portion 1710, throat 1720, diverging portion 1730, straight portion 1750 and exit portion 1740. This nozzle 1700 has a longer straight section 1750 than the nozzle 1600 shown in FIGS. 16A-B and is similar in overall length to the XL Venturi #6 nozzle shown in FIG. 15, with a total length of 11.71". The dimensions are identical to those of the nozzle 1600 depicted in FIGS. 16A-B except that the straight portion 1750 is 5.20" in length.

As the sound production from the air exiting the nozzle is very dependent on the air speed, a design that has a lower air exit velocity without reducing the velocity of the abrasive particles allows for equal or greater productivity while greatly reducing sound volume. The new nozzles add a straight section (neither converging nor diverging) to the end of a conventional nozzle design. This extends the particle accelerating section while reducing the exit Mach number. The extension of the accelerating section is based on the maximum Mach number being achieved at the end of the diverging section, with this maintained more or less until the end of the straight section. The added interaction distance between the slower abrasives in the flow and the air slows down the air in a similar way as wall friction, more efficiently accelerating the abrasive particles while reducing the nozzle exit velocity.

Figure 18:
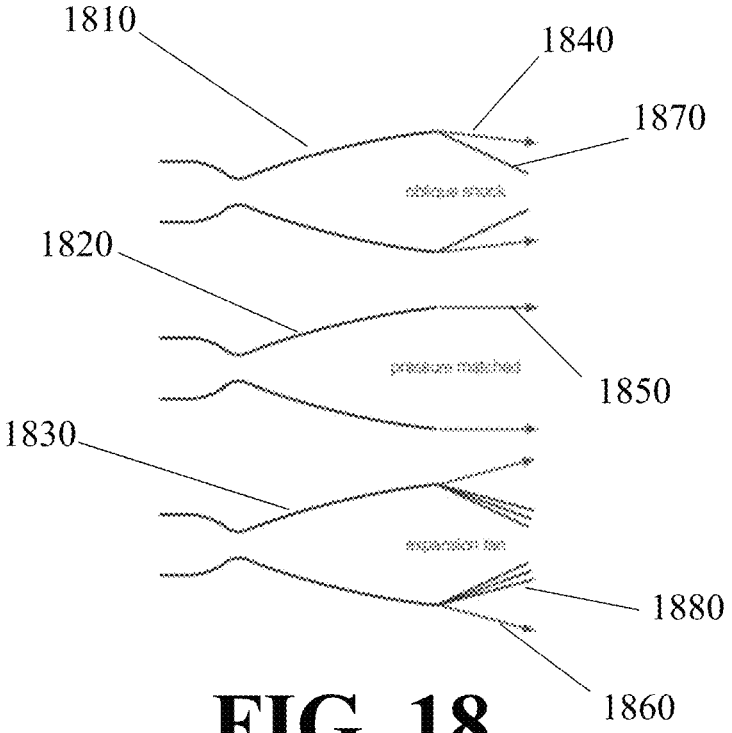
FIG. 18 is a schematic illustrating convergent-divergent nozzle expansion.

FIG. 18 is a schematic illustrating convergent-divergent nozzle expansion in overexpanded 1810, fully expanded 1820, and underexpanded 1830 conditions. Conventional abrasive blasting nozzles are operated in general at what is considered an overexpanded condition, meaning that the flow passes through an oblique shock 1870 as it exhausts and contracts 1840 after the nozzle exit. Flow is supersonic throughout the divergent portion of the nozzle and at the exit, and the jet pressure adjusts to the atmospheric pressure by means of oblique shock waves 1840 outside the exit plane. In contrast, fully expanded flow 1850 does not expand or contract after exit, while underexpanded flow expands 1860 after the exit with expansion fans 1880.

Considering a #6 nozzle, a fully expanded nozzle with an exit-to-throat area ratio of $A/A^*=2.15$ would be driven by a 183 psi pressure reservoir and achieve an exit Mach number of 2.3. Reducing the reservoir pressure can, under the right circumstances, induce a normal shock at the exit plane of a nozzle, substantially reducing the velocity of the gas as it exits the nozzle. However, reducing the reservoir pressure of a conventional abrasive blasting nozzle reduces the particle velocity and renders such a setup impractical. However, the effect of blasting media on the supersonic flow structure leads to normal shock formation at higher than expected reservoir pressures when the supersonic section is uniformly extended. A long high Mach number nozzle section followed by a normal shock at the nozzle exit reduces the exit speed of the air and thus the acoustic noise generation. This has the same effect as running an abrasive-free nozzle at a low enough pressure to produce a normal shock wave at the exit. Having a normal shock wave at the exit drastically reduces the air exit velocity with little effect on the net abrasive velocity.

The straight cylindrical section also causes some frictional losses just from wall surface roughness, which results in a slightly lower Mach number toward the end of the nozzle. For a nominal friction coefficient of 0.005 over the length of a straight section of 2.56 inches, this results in a drop in the Mach number from M=2.3 to M=1.8 for example. This condition is even more overexpanded and more likely to result in a normal shock wave where the output is subsonic and quiet.

Figure 19A:
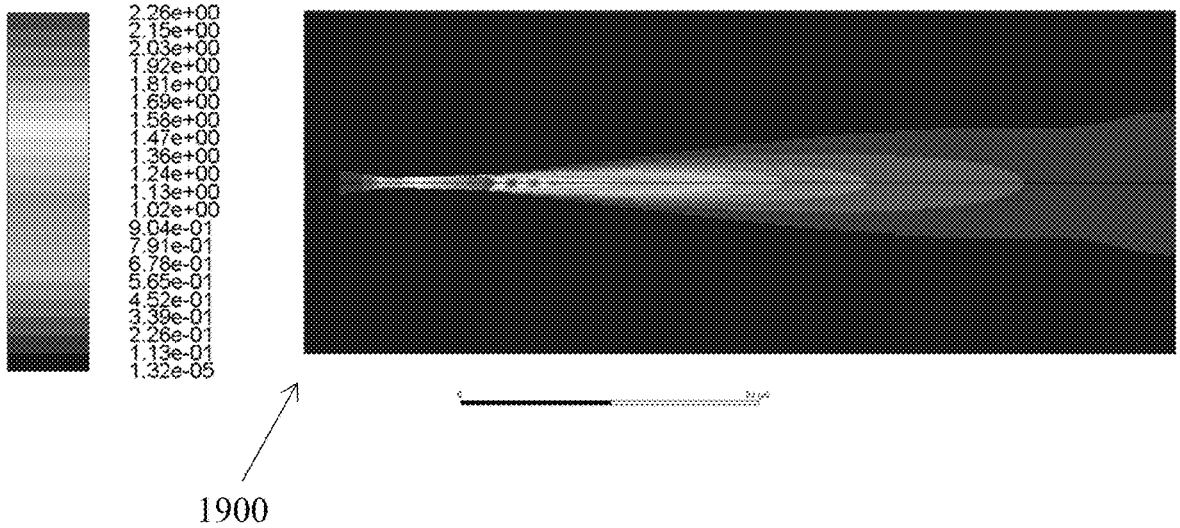
FIGS. 19A-B are CFD results showing Mach number distributions at 67 psig nozzle pressure using ANSYS Fluent for a Marco #6 nozzle (FIG. 19A) and for an improved nozzle according to an embodiment of the present invention (FIG. 19B).
Figure 19B:
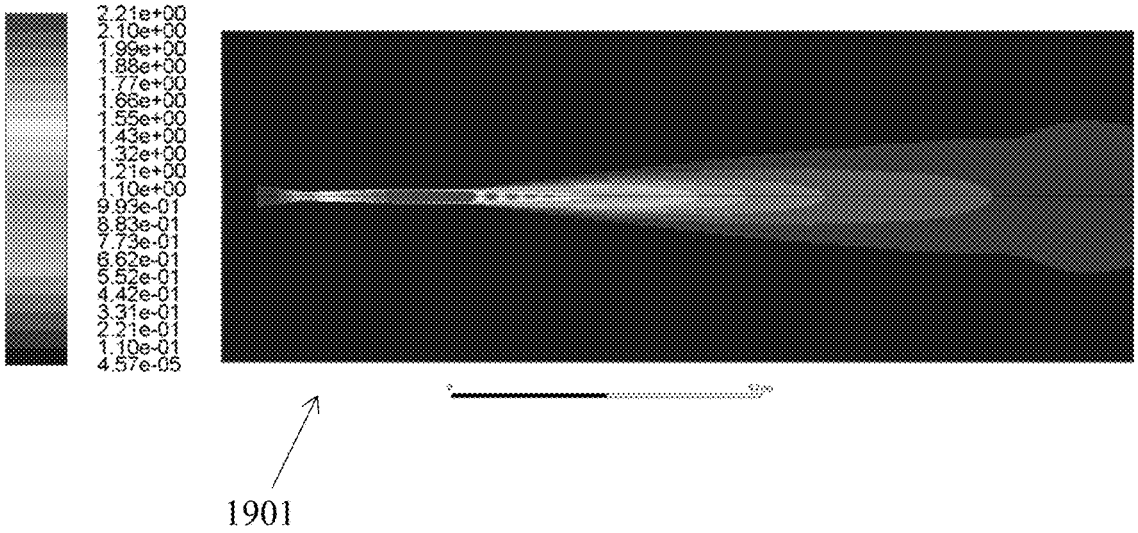
Figure 20A:
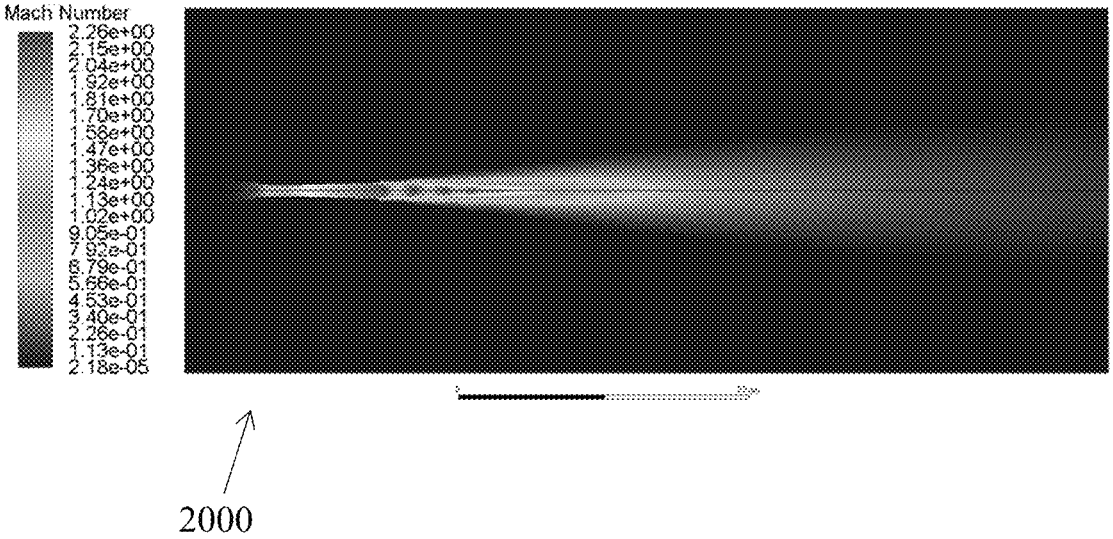
FIGS. 20A-B are CFD results showing Mach number distributions at 100 psig nozzle pressure using ANSYS Fluent for a Marco #6 nozzle (FIG. 20A) and for an improved nozzle according to an embodiment of the present invention (FIG. 20B).
Figure 20B:
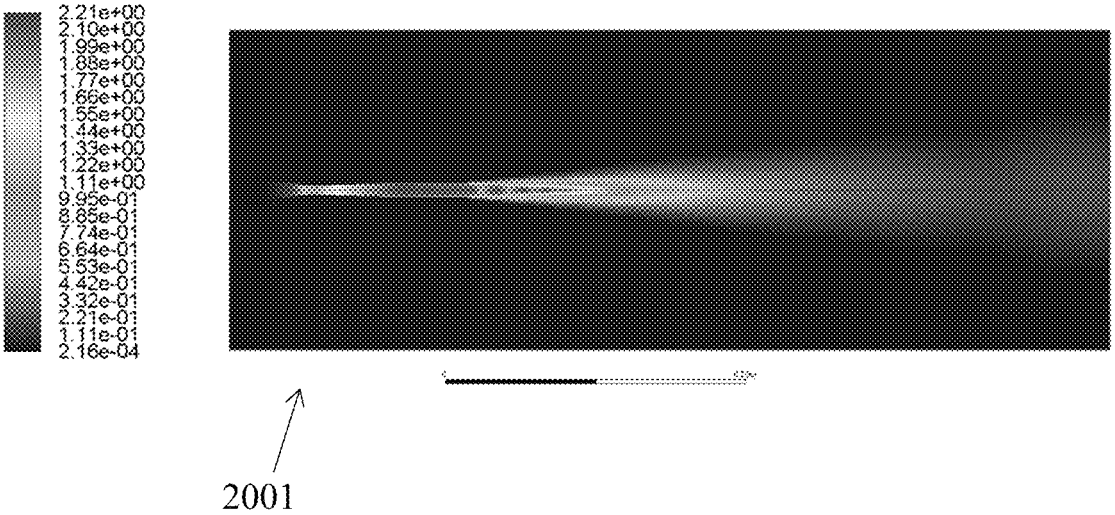

FIGS. 19A-B are CFD results 1900, 1901 showing Mach number distributions at 67 psig nozzle pressure using ANSYS Fluent for single phase compressible air flow with no media for a Marco #6 nozzle (FIG. 19A) and for an improved nozzle according to an embodiment of the present invention (FIG. 19B). FIGS. 20A-B are CFD results 2000, 2001 showing Mach number distributions at 100 psig nozzle pressure using ANSYS Fluent for a Marco #6 nozzle (FIG. 20A) and for an improved nozzle according to an embodiment of the present invention (FIG. 20B). Results clearly show that the improved nozzle has an extended acceleration section over a variety of conditions in comparison to a standard Marco #6 nozzle. In this model the improved nozzle with 67 psig has a slightly lower maximum Mach number than the Marco #6 nozzle (2.21 versus 2.26), but a longer section over which there is supersonic flow to accelerate particles. Similar results were found at a 100 psig nozzle pressure.

Figure 21A:
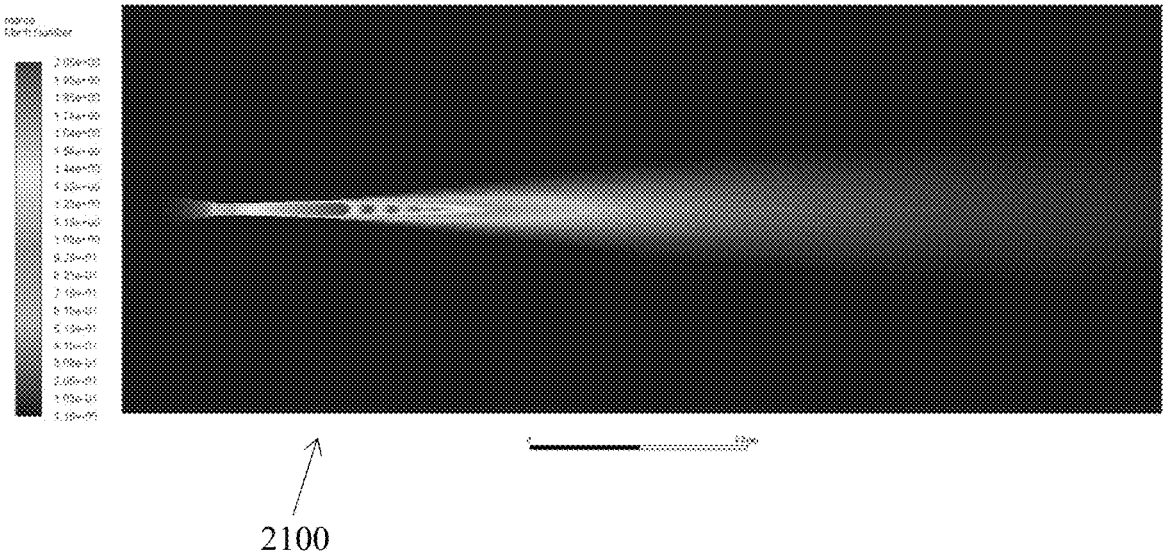
FIGS. 21A-B are CFD results showing Mach number distributions at 67 psig nozzle pressure with added wall drag using ANSYS Fluent for a Marco #6 nozzle (FIG. 21A) and for an improved nozzle according to an embodiment of the present invention (FIG. 21B).
Figure 21B:
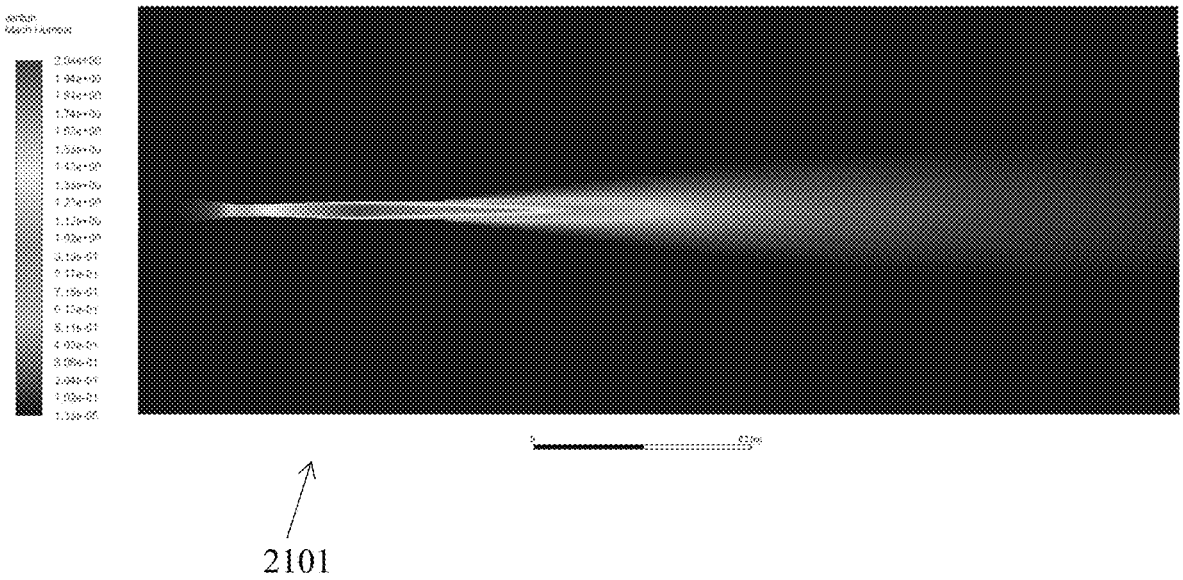

FIGS. 21A-B are CFD results 2100, 2101 showing Mach number distributions at 67 psig nozzle pressure with added wall drag using ANSYS Fluent for a Marco #6 nozzle (FIG. 21A) and for an improved nozzle according to an embodiment of the present invention (FIG. 21B). The added wall drag uses an increased wall friction coefficient to simulate drag from particles on the flow. The main takeaway from this result is that the long straight nozzle section of the improved nozzle creates a greater effect on the flow structure.

The productivity and noise performance of the new nozzles described above were compared to standard commercially available #6 nozzles including a standard #6 Marco Venturi and an extra-long (XL) Venturi. Prior to testing, twenty 18 inch×18 inch panels of 14 gauge steel were uniformly powder coated (10-12 mil coating thickness) to be used to evaluate nozzle productivity (time required to clean the panel to a set level). All tests were conducted with new 30/40 garnet media at a nozzle pressure of 67 psi.

For each nozzle tested the sound level was measured using a sound level meter at the operator's left shoulder while operating the nozzle into open air (to avoid the sound generated by sand hitting metal during actual blasting). The sound levels for the ⅓ octave bands were measured for a 10 second period and MIN, MAX and AVG sound levels were automatically calculated and stored. Background sound levels were also recorded to confirm that background noise did not contribute to the measured noise levels of the nozzles.

Next, video was recorded of each nozzle as it was used to blast one side of a powder coated test panel. The video was used to quantify the productivity of each nozzle (determine the time required to clean the test panel to a desired finish). The blaster's feedback after using each nozzle was also noted, including impressions of sound levels and productivity.

Table 1 summarizes the key results of the testing along with some operator comments. From the first round of testing the quietest and most productive nozzle was an improved nozzle termed Oceanit BN6V1, or Oceanit Short SS, which is the nozzle shown schematically in FIGS. 17A-B. It was 16 dB quieter and cleaned a test panel in 51 seconds vs 69 seconds for the standard long Venturi. The XL nozzle (XL Venturi #6) showed some improvement in sound performance but no gains in productivity, and was deemed too large and heavy for everyday use.

TABLE 1

Summary of test results. (30/40 garnet at 70p5i nozzle pressure)

| Nozzle | Sound Level (dB) | Time to clean panel (sec) | Operator Notes |
|---|---|---|---|
| Marco #6 Venturi | 110.8<br>109.2 | 69<br>41 | Typical Venturi nozzle. |
| Oceanit BN6V1 | 94.7<br>94.0 | 51<br>39 | The operator's favorite nozzle. Noticeably lower sound with greatest productivity. Didn't heat warp the test panel as much as the standard Venturi. Less kickback than the standard nozzle (may be due to the weight of the Oceanit nozzle which is solid stainless steel). |
| Oceanit BN6V2 | 93.1<br>94.2 | 75<br>48 | Lower sound and similar productivity to standard Venturi. Extra length and weight made it less desirable than the Oceanit Short SS. |
| XL | 97.9 | 72 | Required more sand to eliminate nozzle screech. |

Based on the first round results, a second trial of the Marco #6 Venturi and the two straight section Oceanit nozzles was performed (also shown in Table 1). Again, the Oceanit Short SS was the operator's favorite nozzle, and was 15.2 dB quieter than the standard Marco #6 Venturi and cleaned a test panel in 39 seconds (vs 41 sec for the standard Marco #6 Venturi nozzle). The Oceanit BN6-V1 was noticeably quieter than the Marco #6 to the point where the operator felt ear protection was unnecessary, was more productive, had less kickback and caused less heat warp of the test panel.

Figure 22:
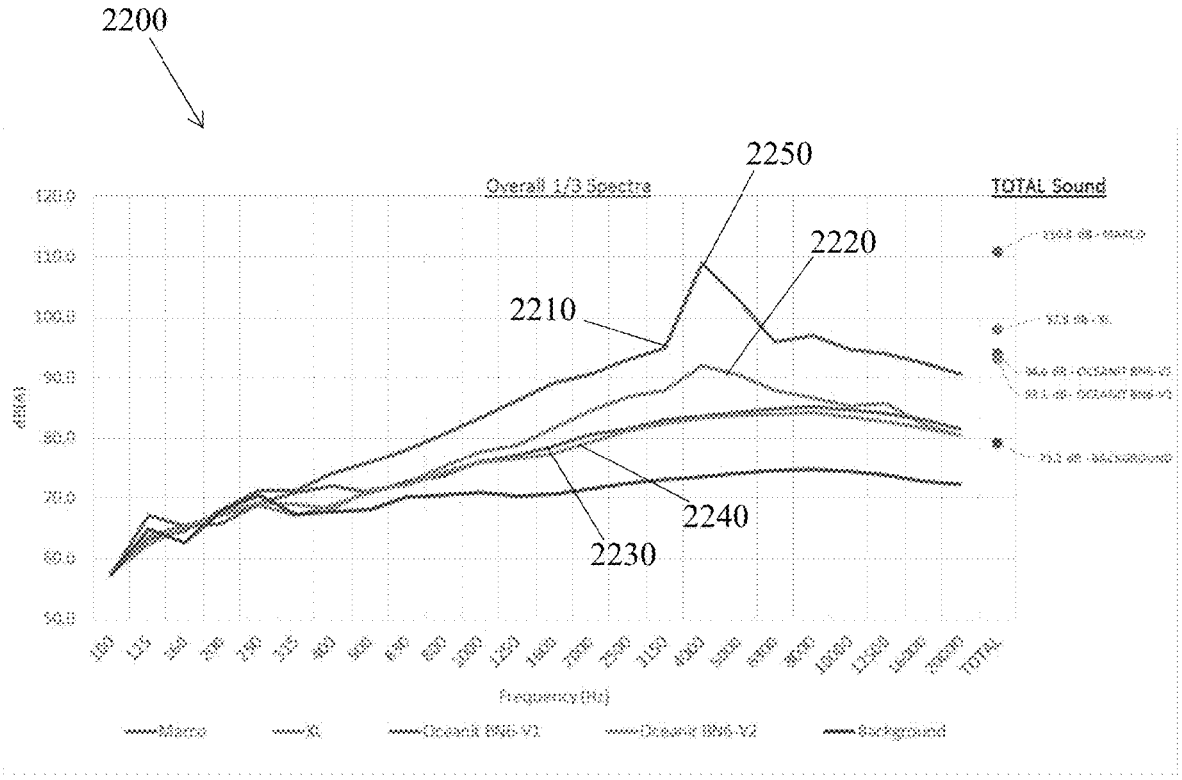
FIG. 22 is a graph showing average ⅓ octave sound spectra for a variety of nozzles.

The average sound levels measured for the ⅓ octave bands 2200 are shown in FIG. 22. These confirm that the sound levels for the two new straight section nozzles 2230 (BNG-V1), 2240 (BNG-V2) are lower than the standard Venturi 2210 across the entire spectrum and substantially lower than the Venturi XL 2220 across most of the spectrum as well. Also worth noting is the spike 2250 centered on 4000 Hz for the standard Venturi nozzle (Marco #6) which may be associated with greater turbulence generation from a high-speed jet and/or jet screech—which is avoided by a subsonic exit velocity after a normal shock at the nozzle exit.

Further testing was conducted of the new nozzle with the shorter straight section (Oceanit BN6V1) against the standard Marco #6 Venturi nozzle using steel shot media at a nozzle pressure of approximately 90 psi. The same coated panels described for the above testing were used to measure nozzle productivity (the time to blast clean a panel). Two trials of each nozzle were conducted. Results are shown in Table 2 below. In the first trial the new nozzle performed equal to the standard nozzle (~53 seconds each to clean a panel). In the second trial the new nozzle outperformed the standard nozzle (30 seconds vs. 47 seconds). Generally, the second trial is more reliable as the user has had time to adjust to a particular nozzle.

TABLE 2

Steel shot 90p5i

| Nozzle | Sound Level (dB) | Time to clean panel (sec) | Operator Notes |
|---|---|---|---|
| Marco # 6 Venturi | n/a | 53<br>47 | Typical Venturi nozzle. |
| Oceanit BN6V1 | n/a | 53<br>30 | Operators noted that the Oceanit BN6-V1 was noticeably quieter. |

Thus, the new reduced noise producing abrasive blasting nozzle is demonstrated to be superior in a commercial abrasive blasting setting. High particle speeds produce productive nozzles. Low exit air velocities produce low noise nozzles. The new nozzles maintain or improve the abrasive particle velocity exiting the nozzle while reducing the exit air velocity. The new nozzles (based on a #6 Venturi) utilize an extended exit section which extends the high-Mach number acceleration zone of the nozzle while producing a much lower exit velocity, in part (in some embodiments) through the creation of a normal shock wave at the end of the nozzle. The productivity of the new nozzles was shown to be better than the standard Marco #6 Venturi nozzle in tests with garnet and steel shot while achieving 17 dB noise reduction over commercial nozzles, reduced kickback and resulting user fatigue, and improved handling characteristics. CFD modeling shows an improved particle acceleration zone.

Reduction in employee exposure to hazardous noise to below the OSHA 8-Hour Time Weighted Average alleviates the employers need to modify employees' current practices, decreases the need for personal protective equipment (PPE), reduces the likelihood of injury in the case of PPE failure, and ensures that personnel in adjacent "safe zones" are guaranteed to be safe from exposure. Most importantly, reducing noise in the blasting facility to 90 dBA or less allows workers to operate for a full 8-hour standard work day within OSHA compliance.

Although testing of a #6 nozzle embodiment is described above, other embodiments may be any size, including #8, #7, and #5 nozzles and a #6 90-degree nozzle. The same design can be applied to any converging-diverging nozzle, using any type of abrasive media/material, including coal slag, garnet, acrylic, etc. The new nozzles may be made, for example, of ceramic or stainless steel (with or without a wear-resistant ceramic liner), and of any known nozzle material. The nozzles may have protective grips to improve handling and eliminate concerns of static electricity for stainless steel versions. The nozzles may be designed for and used with a variety of hose pressures and blast patterns.

SUMMARY AND SCOPE

As will be appreciated from the description, drawings and examples set forth above and referenced herein, the reduced noise abrasive blasting systems of the present invention allow for abrasive blasting with significantly reduced resultant noise while providing the equivalent or improved productivity and efficiency compared with conventional abrasive blasting systems. The improved reduced noise blasting system promotes worker health and safety and a quieter environment for those in the vicinity.

The improved abrasive blasting system exploits a lengthened accelerator section in the hosing and/or nozzle in order to maintain particle velocity while decreasing the gas exit velocity. A straight bore nozzle can be used to produce the desired active abrasive area. The maintained particle velocity provides the equivalent abrasive productivity while the decreased gas velocity provides for the reduced resultant noise.

While specific preferred embodiments and examples of fabrication and testing of the invention have been illustrated and described, it will be clear that the invention is not so limited. Numerous modifications or alterations, changes, variations, substitutions and equivalents will occur to those skilled in the art without deviating from the spirit and scope of the invention, and are deemed part and parcel of the invention disclosed herein.

By way of example and not limitation, the nozzle and hose dimensions, and the coupling types, and the specific configuration and sizes of hose, couplings, nozzle and accelerator section, can be varied in accordance with the general principals of the invention as described herein in order to accommodate different working conditions, target materials, project specification, budgetary considerations and user preferences. The nozzle may have any throat diameter, e.g. 1, 2, 3, 4, 5, 6, 7, 8, 9, 10, 11, 12, etc., including in embodiments featuring a new nozzle having a straight section. In addition, more than one transition coupling and accelerator hose section and inside diameter may be employed in the systems of the subject invention. The invention described herein is inclusive of all such modifications and variations.

Further, the invention should be considered as comprising all possible combinations of every feature described in the instant specification, appended claims, and/or drawing figures which may be considered new, inventive and industrially applicable.

Multiple variations and modifications are possible in the embodiments of the invention described here. Although certain illustrative embodiments of the invention have been shown and described here, a wide range of modifications, changes and substitutions is contemplated in the foregoing disclosure. While the above description contains many specifics, these should not be construed as limitations on the scope of the invention, but rather as exemplifications of one or another preferred embodiment thereof. In some instances, some features of the present invention may be employed without a corresponding use of the other features.

Accordingly, it is appropriate that the foregoing description be construed broadly and understood as being given by way of illustration and example only, the spirit and scope of the invention being limited only by the claims which ultimately issue.

The invention claimed is:

1. A reduced noise abrasive blasting nozzle assembly for abrasive blasting, the abrasive blasting nozzle assembly comprising: a first portion having a first internal diameter; a constricted portion having an internal diameter less than the first internal diameter; a converging portion connecting the first portion to the constricted portion and having a converging internal diameter; and a straight portion downstream from the constricted portion, having a constant internal diameter less than that of the first portion; wherein the straight portion has a length such that a velocity of gas exiting the blasting nozzle assembly is reduced by at least 30% relative to the blasting nozzle assembly without the straight portion when operated with a predetermined gas/particle mix and pressure, whereby blasting nozzle assembly noise is reduced; wherein in operation fluid flows through the first portion, the converging portion, the constricted portion and the straight portion in that order.

2. The reduced noise abrasive blasting nozzle assembly for abrasive basting of claim 1, wherein the constricted portion, converging portion, and straight portion are all portions of a nozzle.

3. The reduced noise abrasive blasting nozzle assembly for abrasive blasting of claim 2, further comprising a diverging portion connecting the constricted portion with the straight portion, wherein the straight portion immediately follows the diverging portion.

4. The reduced noise abrasive blasting nozzle assembly for abrasive blasting of claim 3, wherein the converging portion, constricted portion, diverging portion and straight portion together constitute a nozzle and the constricted portion is the throat of the nozzle.

5. The reduced noise abrasive blasting nozzle assembly for abrasive blasting of claim 4, wherein the straight portion is at least 2" in length.

6. The reduced noise abrasive blasting nozzle assembly for abrasive blasting of claim 5, wherein the straight portion is less than 5.2" in length.

7. The reduced noise abrasive blasting nozzle assembly for abrasive blasting of claim 6, wherein the straight portion is at least 2.5" in length.

8. The reduced noise abrasive blasting nozzle assembly for abrasive blasting of claim 7, wherein the nozzle is a #6 nozzle.

9. The reduced noise abrasive blasting nozzle assembly for abrasive blasting of claim 2, wherein the internal diameter of the straight portion is selected to produce a predetermined "hot spot" diameter of abrasive action.

10. The reduced noise abrasive blasting nozzle assembly for abrasive blasting of claim 1, further comprising a media tank, abrasive media, compressed gas to carry the abrasive media, and one or more hose sections.

11. A reduced noise abrasive blasting nozzle assembly for abrasive blasting, comprising: a hose comprising a first portion having a first internal diameter; a nozzle assembly connected to the first portion of the hose comprising: a constricted portion having an internal diameter less than the first internal diameter; a converging portion connecting the first portion to the constricted portion, the converging portion having a converging internal diameter; and a straight portion downstream from the constricted portion, the straight portion having a constant internal diameter less than that of the first portion; wherein the straight portion has a length such that a velocity of gas exiting the blasting nozzle assembly is reduced by at least 30% relative to the blasting nozzle assembly without the straight portion when operated with a predetermined gas/particle mix and pressure, whereby blasting nozzle assembly noise is reduced; wherein, in operation, fluid flows through the first portion, the converging portion, the constricted portion, and the straight portion, in that order.

12. The reduced noise abrasive blasting nozzle assembly for abrasive blasting of claim 11, wherein the nozzle assembly further comprises a diverging portion connecting the constricted portion with the straight portion, wherein the straight portion immediately follows the diverging portion.

* * * * *